US006568361B2

(12) United States Patent
Hara et al.

(10) Patent No.: US 6,568,361 B2
(45) Date of Patent: May 27, 2003

(54) VALVE OPERATING DEVICE FOR INTERNAL COMBUSTION ENGINES

(75) Inventors: Seinosuke Hara, Kanagawa (JP); Keisuke Takeda, Kanagawa (JP); Yoshihiko Yamada, Kanagawa (JP); Yoshiaki Miyazato, Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 33 days.

(21) Appl. No.: 09/927,343

(22) Filed: Aug. 13, 2001

(65) Prior Publication Data

US 2002/0033152 A1 Mar. 21, 2002

(30) Foreign Application Priority Data

Sep. 21, 2000 (JP) ..... 2000-286341
Sep. 27, 2000 (JP) ..... 2000-293573

(51) Int. Cl.[7] ..... F01L 1/32
(52) U.S. Cl. ..... 123/90.29; 123/90.16
(58) Field of Search ..... 123/90.16, 90.15, 123/90.17

(56) References Cited

U.S. PATENT DOCUMENTS 4,397,270 A 8/1983 Aoyama ..... 123/90.16
6,311,659 B1 * 11/2001 Pierik ..... 123/90.24

FOREIGN PATENT DOCUMENTS

JP 55-137305 10/1980

* cited by examiner

*Primary Examiner*—Thomas Denion
*Assistant Examiner*—Jaimie Corrigan
(74) *Attorney, Agent, or Firm*—Foley & Lardner

(57) ABSTRACT

A valve operating device for an internal combustion engine enabling both valve timing and valve lift characteristic to be varied depending on engine operating conditions includes intake and exhaust camshafts, an eccentric cam fixed to a first one of the intake and exhaust camshafts so that an axis of the eccentric cam is eccentric to an axis of the first camshaft. A rockable cam is supported on the first camshaft so that the rockable cam rotates or oscillates about the axis of the first camshaft. A rocker arm is oscillatingly supported on an outer periphery of the eccentric cam so that a center of an oscillating motion of the rocker arm revolves around the axis of the first camshaft. Also provided is a control shaft variably controlling the center of the oscillating motion of the rocker arm.

8 Claims, 21 Drawing Sheets

VALVE OPERATING DEVICE FOR INTERNAL COMBUSTION ENGINES

TECHNICAL FIELD

The present invention relates to a valve operating device for an internal combustion engine enabling valve timing and valve lift characteristic (valve lift and working angle or valve open period) of intake and/or exhaust valves to be varied depending upon engine operating conditions, and specifically to a variable valve timing and variable valve lift characteristic device applicable to an internal combustion engine equipped with an intake camshaft and an exhaust camshaft.

BACKGROUND ART

In recent years, there have been proposed and developed various variable valve timing and lift control devices each of which enables engine valve timing and valve lift characteristic of engine valves to be varied depending upon engine operating conditions, so as to reconcile improved fuel economy and enhanced combustion stability and driveability during low-speed low-load operation and enhanced intake-air charging efficiency and increased engine power during high-speed high-load operation. On such variable valve timing and lift control mechanism has been disclosed in Japanese Patent Provisional Publication No. 55-137305 (hereinafter is referred to as "JP55-137305"). FIG. 21 shows the variable valve timing and lift device disclosed in JP55-137305. In the device shown in FIG. 21, a camshaft 2 is provided nearby an upper middle position of the upper deck of a cylinder head 1. Camshaft 2 is integrally formed on its outer periphery with a cam 2*a*. A control shaft 3 whose axis is parallel to the axis of camshaft 2 is provided nearby the right-hand side of the camshaft (viewing FIG. 21). An eccentric cam 4 whose axis is eccentric to the axis of control shaft 3 is fixed to the control shaft. A rocker arm 5 is oscillatingly or rockably supported on the eccentric cam of control shaft 3. An intake valve 6 is slidably provided in cylinder head 1. A rockable cam 8 is located at the upper end of intake valve 6 through a valve lifter 7. Rockable cam 8 is oscillatingly or rockably supported by a pivot shaft 9 whose axis is laid out above valve lifter 7 in parallel with the axis of camshaft 2. The lower cam surface 8*a* of rockable cam 8 is in abutted-engagement with the upper surface of valve lifter 7. One end 5*a* of rocker arm 5 is in abutted-engagement with the cam contour surface of cam 2*a*, while the other end 5*b* of rocker arm 5 is in abutted-engagement with the upper end face 8*b* of rockable cam 8, so as to transmit cam action (lift) of cam 2*a* through rockable cam 8 and valve lifter 7 to intake valve 6, so that the intake valve is opened and closed. Control shaft 3 is rotatable within a predetermined angular range by means of an actuator (not shown). A spring 10 is provided to permanently bias the rockable cam 8 clockwise in such a manner as to force the upper end face 8*b* of rockable cam 8 into contact with the other end 5*b* of rocker arm 5. By energizing the actuator in response to a control signal from a controller (not shown), control shaft 3 is adjusted to a desired angular position based on engine operating conditions such as engine speed and load, so that the center of eccentric cam shifts and thus the center of oscillating motion of rocker arm 5 also changes. As a result, the abutted position between the other rocker-arm end 5*b* and the rockable-cam upper end face 8*b* shifts in the vertical direction (viewing FIG. 21), and thus the abutted position between the cam surface 8*a* of rockable cam 8 and the valve-lifter upper surface shifts. In this manner, a locus of oscillating motion of rockable cam 8 also changes, with the result that the valve timing of intake valve 6, that is, both intake-valve open timing (IVO) and intake-valve closure timing (IVC), and the valve lift of intake valve 6 can be variably controlled. Furthermore, there is a possibility of a slight change in the distance between the axis of camshaft 2 and the axis of pivot shaft 9 during operation of the engine. This may deteriorates the accuracy of variable valve timing and lift characteristic control.

SUMMARY OF THE INVENTION

It is, therefore in view of the above disadvantages, an object of the invention to provide an improved valve operating device for an internal combustion engine enabling valve timing and valve lift characteristic to be varied depending on engine operating conditions.

In order to accomplish the aforementioned and other objects of the present invention, a valve operating device for an internal combustion engine enabling both valve timing and valve lift characteristic to be varied depending on engine operating conditions comprises intake and exhaust camshafts, an eccentric cam fixedly connected to a first one of the intake and exhaust camshafts so that an axis of the eccentric cam is eccentric to an axis of the first camshaft, a rockable cam supported on the first camshaft so that the rockable cam rotates or oscillates about the axis of the first camshaft, a rocker arm oscillatingly supported on an outer periphery of the eccentric cam so that a center of an oscillating motion of the rocker arm revolves around the axis of the first camshaft, and a control shaft that variably controls the center of the oscillating motion of the rocker arm.

According to another aspect of the invention, a valve operating device for an internal combustion engine enabling both valve timing and valve lift characteristic to be varied depending on engine operating conditions comprises intake and exhaust camshafts, a rockable cam oscillatingly supported on a first one of the intake and exhaust camshafts for operating an engine valve associated with the first camshaft by an oscillating motion of the rockable cam, a drive cam fixedly connected to an outer periphery of the second camshaft adapted to be driven by an engine crankshaft for operating an engine valve associated with the second camshaft, a power-transmission mechanism that produces the oscillating motion of the rockable cam by converting a rotary motion of the second camshaft into an oscillating motion, and a control mechanism that variably controls a valve lift characteristic of the engine valve associated with the first camshaft by controlling an angular position of the first camshaft and thus changing a sliding-contact position of the rockable cam with respect to the engine valve associated with the first camshaft.

According to a still further aspect of the invention, a valve operating device for an internal combustion engine enabling both valve timing and valve lift characteristic to be varied depending on engine operating conditions comprises intake and exhaust camshafts, both adapted to be driven by an engine crankshaft, a rockable cam oscillatingly supported on a first one of the intake and exhaust camshafts for operating an engine valve associated with the first camshaft by an oscillating motion of the rockable cam, a drive cam fixedly connected to an outer periphery of the second camshaft for operating an engine valve associated with the second camshaft, a power-transmission mechanism that produces the oscillating motion of the rockable cam by converting a rotary motion of the first camshaft into an oscillating motion, and a control mechanism that variably controls a valve lift characteristic of the engine valve associated with the first camshaft by controlling an attitude of the power-transmission mechanism and thus changing a sliding-contact position of the rockable cam with respect to the engine valve associated with the first camshaft.

The other objects and features of this invention will become understood from the following description with reference to the accompanying drawings.

DESCRIPTION OF THE PREFERRED EMBODIMENTS

Figure 21:
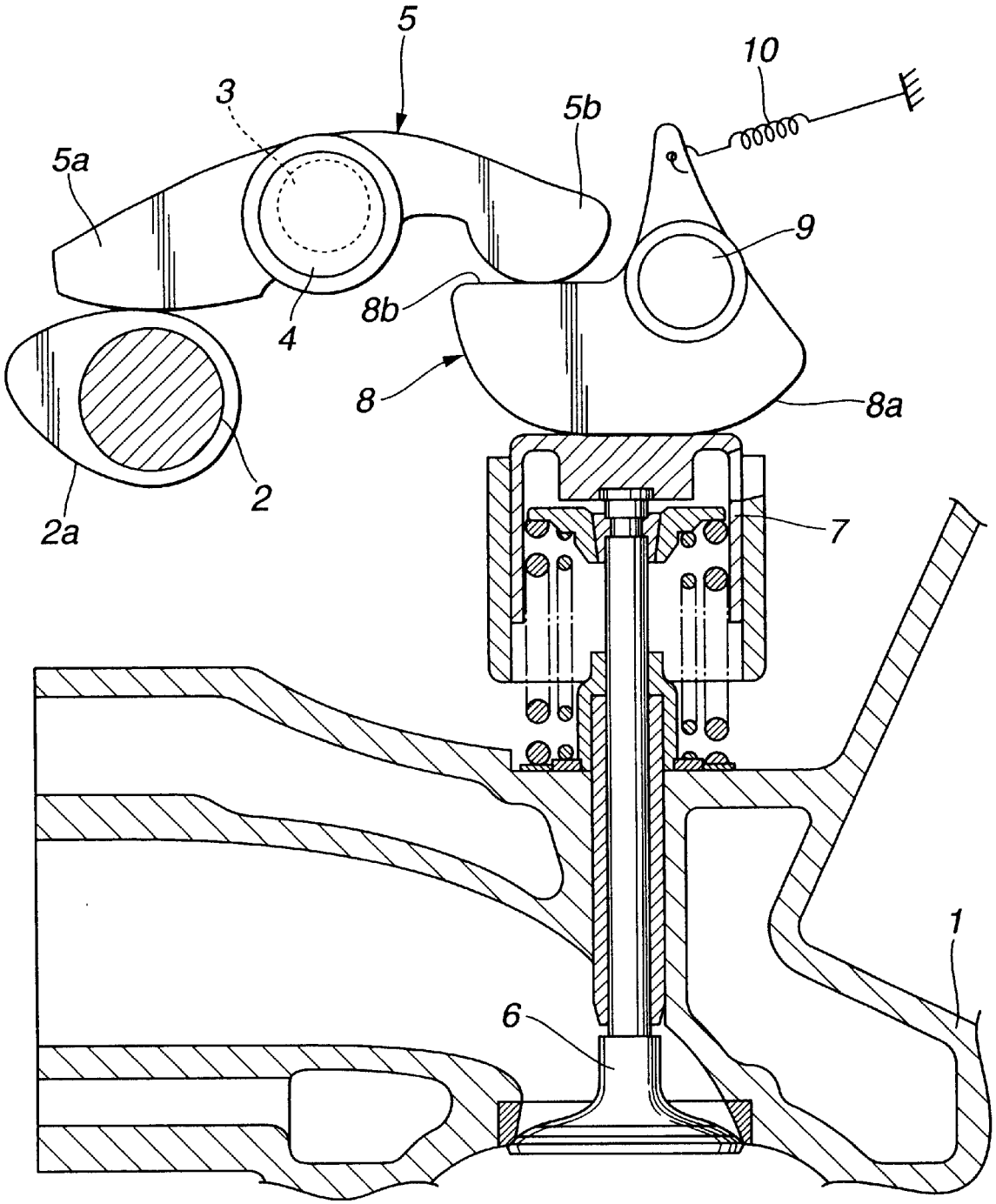
FIG.21 (PRIOR ART)
FIG. 21 is a cross-sectional view of the essential part of the conventional variable valve timing and lift control device.

However, in the variable valve timing and lift control device disclosed in JP55-137305, camshaft 2 and control shaft 3 are constructed as two separate component parts, and additionally the control shaft is located above camshaft 2. This undesirably increases the overall height of cylinder head 1. Such a device requires a comparatively large installation space for control shaft 3. Additionally, control shaft 3 is provided separately from camshaft 2, and therefore the device of FIG. 21 requires a supporting structure needed to rotatably support the control shaft on the cylinder head. In such a case, a great alteration in the upper structure of cylinder head 1 must be made. This results in complicated manufacturing processes, and thus increases total production costs. In addition to the two separate shafts, namely camshaft 2 and control shaft 3, the device of FIG. 21 requires pivot shaft 9, thereby increasing the number of component parts.

Referring now to the drawings, particularly to FIGS. 1 through 5, the valve operating device of the first embodiment is exemplified in an internal combustion engine with a pair of intake valves (12, 12) and a pair of exhaust valves (13, 13) for each engine cylinder. The valve operating device of the first embodiment is mounted on a cylinder head 11. As can be seen from the circles indicated by the one-dotted line of FIG. 2, a pair of intake valves (12, 12) and a pair of exhaust valves (13, 13) are provided for each engine cylinder. Valve lifters (16, 16) for intake valves (12, 12) and valve lifters (17, 17) for exhaust valves (13, 13) are provided on upper ends of valve stems (not numbered) of the intake and exhaust valves. The valve stems are integrally formed with respective valve heads or valve fillet portions (not shown) of the intake and exhaust valves. Each of valve lifters (16, 16; 17, 17) is constructed as a direct-operated valve lifter or a direct-operated cam follower which is directly operated by means of a cam (that is, a drive cam 18 for the valve lifter 17 of the exhaust-valve side and a rockable cam 22 for the valve lifter 16 of the intake-valve side). Each of the valve lifters has a cylindrical bore closed at its upper end. Valve lifters (16, 16; 17, 17) are slidably accommodated in respective cylindrical valve-lifter supporting bores formed in cylinder head 11. Intake valves (12, 12) and exhaust valves (13, 13) are supported or guided by means of respective valve guides (not numbered) located on both sides of cylinder head 11. An intake camshaft 14 and an exhaust camshaft 15 are laid out at the upper portion of cylinder head 11. In the shown embodiment, intake camshaft 14 and exhaust camshaft 15 are arranged parallel to each other so that axes of the intake and exhaust camshafts extend in the longitudinal direction of the engine. A first eccentric cam 19, which will be fully described later, is provided on exhaust camshaft 15 so that the axis of first eccentric cam 19 is eccentric to the axis of exhaust camshaft 15. On the other hand, a rockable cam 22 is provided on intake camshaft 14. A power-transmission mechanism (simply, a converter) 20 is provided to transmit an input motion (rotary motion) of first eccentric cam 19 to rockable cam 22, while converting the rotary motion of first eccentric cam 19 to linear motion (output motion). A control mechanism 21 is provided for variably controlling a valve lift of each of the intake valves by controlling the angular position (the angular phase) of intake camshaft 14, thus shifting or changing the sliding-contact position of rockable cam 22 relative to the associated intake valve 12 (exactly, the associated intake-valve lifter 16). The valve operating mechanism of the first embodiment is comprised of the intake valve pair (12, 12), exhaust valve pair (13, 13), intake camshaft 14, exhaust camshaft 15, power-transmission mechanism (rotary-to-linear motion converter) 20, and control mechanism 21. A rotational force (torque) of an engine crankshaft is transmitted through a driven sprocket (not shown) and a timing chain (not shown) located at the front end of the engine to exhaust camshaft 15. Exhaust-cam bearing caps 25 are bolted to the upper end of cylinder head 11 by means of bolts 25*a*, and thus the upper bearing halves of exhaust-cam bearing caps 25 are fitted to half-round sections of cylinder head 11. Then, the bores in the cylinder head and caps 25 are bored to take the exhaust-cam bearings. In this manner, exhaust camshaft 15 is rotatably supported by way of the exhaust-cam bearings. Exhaust camshaft 15 is crank-shaped and integrally formed with drive cams (18, 18) by which exhaust valves (13, 13) are opened or closed via the respective exhaust-valve lifters (17, 17). Exhaust camshaft 15 is also formed integral with the previously-noted first eccentric cam 19 (serving as a journal) outside of two adjacent drive cams (18, 18) or between two adjacent engine cylinders (see FIG. 2). Each of the drive cams is formed as a substantially raindrop-shaped circular cam (often called as a "convex cam") in which a top circle and a base circle are joined by a third circular arc. Drive cams 18 have the same cam profile. As clearly shown in FIG. 1, the outer peripheral surface (cam contour surface) of drive cam 18 is in sliding-contact with the upper surface of the associated exhaust valve lifter. First eccentric cam 19 is crank-shaped so that the axis X1 of first eccentric cam 19 is offset from the axis X of exhaust camshaft 15 by a predetermined distance (eccentricity) $\epsilon$. The first eccentric cam is located outside of the two adjacent drive cams (18, 18) or between two adjacent engine cylinders, in such a manner as to be axially spaced apart from the outside of two adjacent exhaust valve lifters (17, 17).

Figure 1:
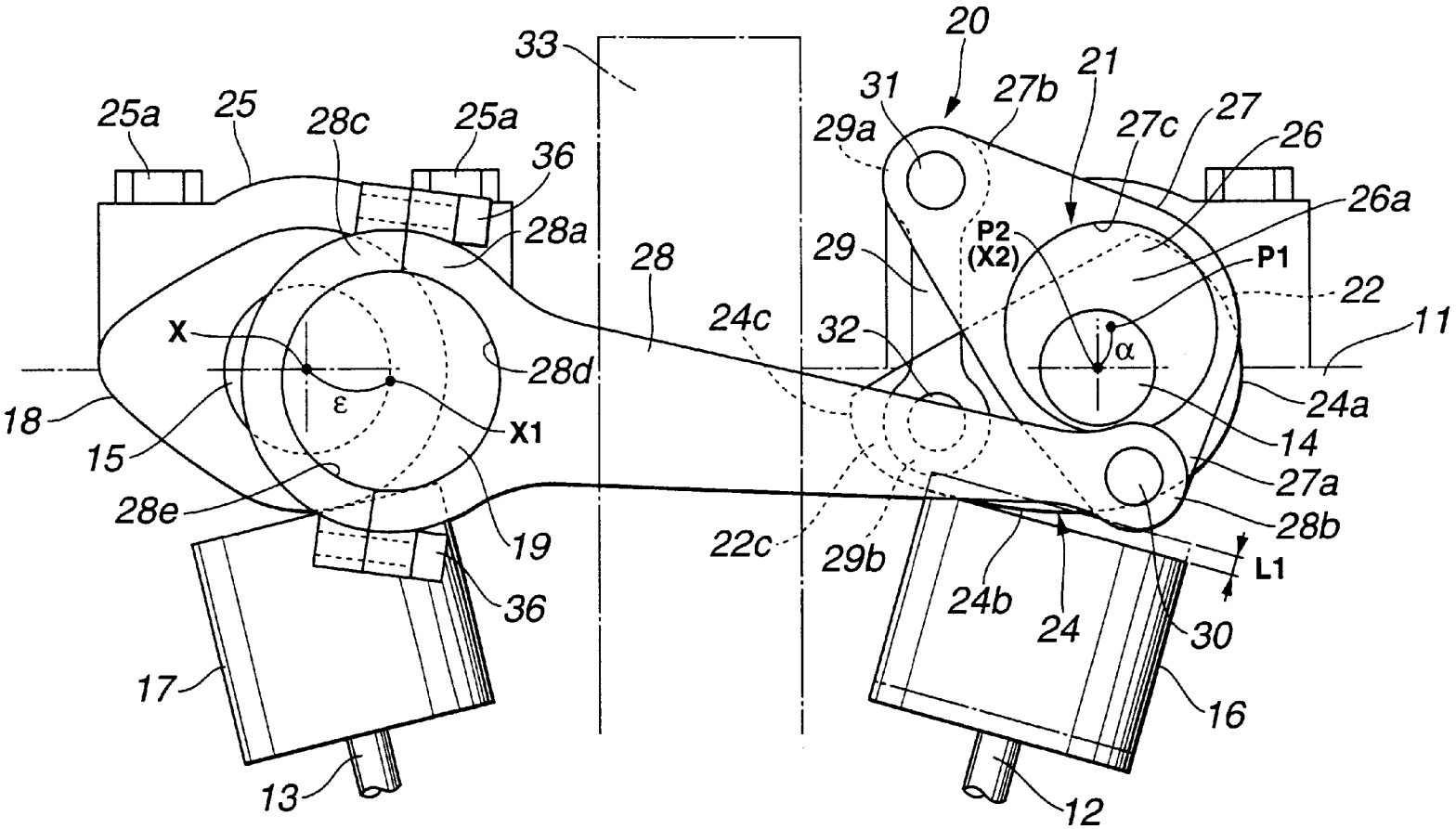
FIG. 1 is a cross-sectional view showing the essential part of a first embodiment of a valve operating device.
Figure 2:
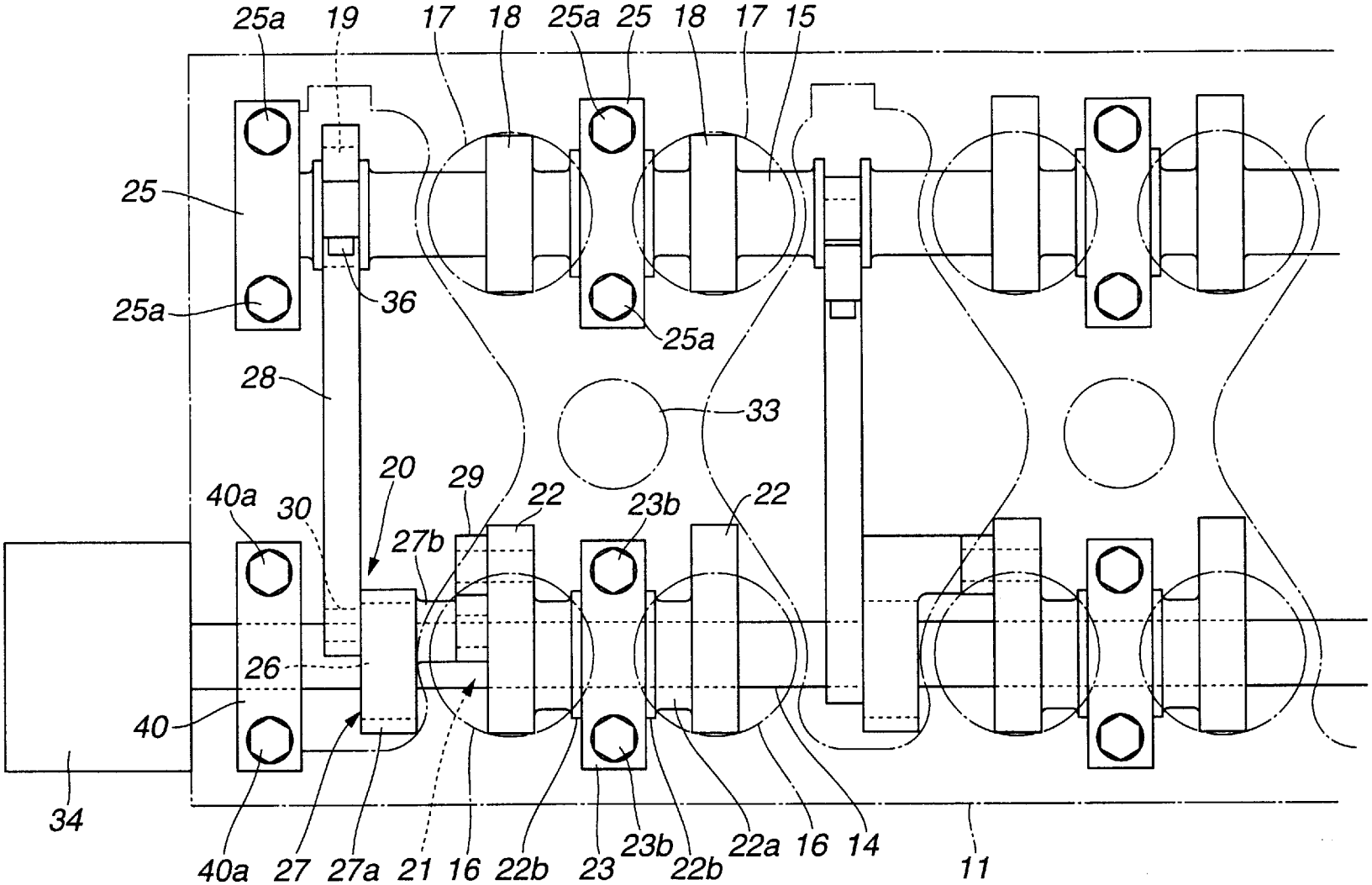
FIG. 2 is a plan view showing the essential part of the valve operating device of the first embodiment.

On the other hand, intake camshaft 14 serves as a control shaft for control mechanism 21. Each of intake-cam bearing brackets or each of intake-cam bearing caps 40 is bolted on both ends to the upper end of cylinder head 11 by means of bolts 40*a*, and thus the upper bearing halves of intake-cam bearing caps 40 are fitted to half-round sections of cylinder head 11. Then, the bores in the cylinder head and caps 40 are bored to take the intake-cam bearings. In this manner, intake camshaft 14 is rotatably supported by way of the intake-cam bearings. Intake camshaft 14 rotatably or oscillatingly supports rockable cams (22, 22) by which intake valves (12, 12) are opened or closed via the respective intake-valve lifters (16, 16). As shown in FIGS. 1 and 2, in particular as viewed from the axial direction in FIG. 2, cam profiles of rockable cams (22, 22) are the same. Also, each of rockable cams (22, 22) is formed into a substantially U shape (in side view). As best seen in FIG. 2, the rockable cam pair, namely the two adjacent rockable cams (22, 22) are integrally connected to each other through a substantially cylindrical rockable-cam base portion 22*a*. Base portion 22*a* defines therein an axially-extending supporting bore in which intake camshaft 14 is rotatably supported. Base portion 22*a* is also formed with a pair of axially-spaced flanged portions (22*b*, 22*b*). An intermediate portion of the outer peripheral surface of base portion 22*a* situated between the two flanged portions (22*b*, 22*b*) serves as a journal. A rockable-cam bracket 23 for the rockable cam pair (22, 22) is bolted on both ends to the upper end of cylinder head 11 by means of bolts 23*b*, and thus upper bearing halves of rockable-cam brackets 23 are fitted to half-round sections of cylinder head 11. Then, the bores in the cylinder head and brackets 23 are bored to take the rockable-cam bearings. In this manner, the intermediate portion of base portion 22*a* of the rockable cam pair (22, 22) is rotatably supported by way of the associated rockable-cam bearing. A cam nose portion 22*c* extends obliquely upwards from base portion 22*a*. Cam nose portion 22*c* is formed with a connecting-pin hole (simply, a pin hole). As can be seen from the cross-sectional view of FIG. 1, each of the two adjacent rockable cams (22, 22) is formed on its lower surface with a base circle portion 24*a*, an intermediate cam surface portion 24*b* (simply, a cam surface portion), and a top circle portion 24*c*. A cam-contour surface 24 is constructed by these three portions 24*a*, 24*b* and 24*c*. Cam surface portion 24*b* is circular-arc shaped and extends from base circle portion 24*a* to top circle portion 24*c*. The cam profiles for base circle portion 24*a* and cam surface portion 24*b* are the same in the two adjacent rockable cams (22, 22). Rockable cam 22 is designed to be brought into abutted-contact (sliding-contact) with a designated point or a designated position of the upper surface of the associated intake-valve lifter 16 depending on an angular position of rockable cam 22 oscillating. As can be appreciated from the cross sections shown in FIGS. 1, 3, 4 and 5, a predetermined angular range of base circle portion 24*a* functions as a base circle section. A predetermined angular range of the cam surface portion 24*b* being continuous with the base circle portion 24*a* functions as a ramp section. A predetermined angular range of the top circle portion 24*c* (or the cam nose portion 22*c*) being continuous with the ramp section of cam surface portion 24*b* functions as a lift section. Power-transmission mechanism 20 of the device of the first embodiment is comprised of the first eccentric cam 19, a rocker arm 27, a link arm 28, and a link rod 29. Rocker arm 27 is oscillatingly or rockably supported on intake camshaft 14 through a second eccentric cam 26 (described later) serving as a control cam included in control mechanism 21. Link arm 28 mechanically links the first eccentric cam 19 to one end (a first end) 27*a* of rocker arm 27. Link rod 29 is provided to mechanically link the other end (a second end) 27*b* of rocker arm 27 to the cam nose portion 22*c* of one of the two rockable cams (22, 22). As shown in FIG. 1, rocker arm 27 is formed into a substantially boomerang shape. Rocker arm 27 has almost the same width dimension as the cam bracket 23. In other words, rocker arm 27 is comparatively short and as wide as the cam bracket. A substantially central portion of rocker arm 27 is bored as a cam hole 27*c*, and thus rocker arm 27 is oscillatingly or rockably supported on second eccentric cam 26 rotatably fitted into the cam hole 27*c*. Rocker arm 27 is formed at its first end 27*a* with a connecting pin hole into which a tip end (or a front end) of a connecting pin 30 is loosely rotatably fitted. The first end 27*a* of rocker arm 27 is connected to link arm 28 by means of the connecting pin 30. Additionally, rocker arm 27 is formed at its second end 27*b* with a connecting pin hole into which a connecting pin 31 is press-fitted. The second end 27*b* of rocker arm 27 is connected to link rod 29 by means of the connecting pin 31. Link arm 28 is formed as a substantially straight link extending in the lateral direction of the engine (exactly, in a direction perpendicular to the axial direction of either one of intake and exhaust camshafts 14 and 15). Link arm 28 is comprised of a comparatively large-diameter annular base portion 28*a* and a protruding end 28*b* extending from a predetermined angular position of the outer periphery of base portion 28*a* in the direction perpendicular to the axial direction of either one of intake and exhaust camshafts 14 and 15. Base portion 28*a* of link arm 28 has a half-split structure. That is, base portion 28*a* is split into a first half-round section (i.e., a half-round bracket or a half-round cap 28*c*) and a second half-round section (a main link-arm base portion). When installing link arm 28 on first eccentric cam 19, firstly, the first and second half-round sections are fitted onto the outer peripheral surface of first eccentric cam 19, and then the first half-round section (half-round cap) 28*c* is bolted to the second half-round section of base portion 28*a* by means of bolts (36, 36), and thus the first and second half-round sections are fitted to each other. At this time, a first fit groove 28*d* is defined between the first half-round section and the outer peripheral surface of first eccentric cam 19, whereas a second fit groove 28*e* is defined between the second half-round section and the outer peripheral surface of first eccentric cam 19, so as to permit first eccentric cam 19 to be rotatably fitted into the base portion 28*a* of link arm 28. On the other hand, the protruding end 28*b* of link arm 28 has a connecting-pin hole into which the other end (or a rear end) of the previously-noted connecting pin 30 is press-fitted. Link rod 29 is formed as a comparatively short, straight link. Link rod 29 is formed on its both ends with a pair of circular portions 29*a* and 29*b*. A pair of connecting-pin holes are bored in the respective circular portions 29*a* and 29*b*. Pin 31, press-fitted into the other end 27*b* of rocker arm 27, is rotatably inserted into the connecting-pin hole of circular portion 29*a*. On the other hand, pin 32, press-fitted into the cam nose portion 22*c* of rockable cam 22, is rotatably inserted into the connecting-pin hole of circular portion 29*b*. Snap rings are fitted to the respective tip ends of pins 30, 31 and 32, to prevent these pins from falling out of the respective connecting-pin holes. A plug post 33 is provided at the transversely central position of cylinder head 11. Control mechanism 21 is comprised of intake camshaft 14 (serving as a control shaft) and second eccentric cam 26 fixed to the intake camshaft. Control mechanism 21 also includes an actuator 34 by which the angular phase of intake camshaft 14 is varied. Second eccentric cam 26 is annular in shape. The axis P1 of second eccentric cam 26 is eccentric to the axis X2 of intake camshaft 14 (the axis P2 of control shaft 14) by a distance $\alpha$. In the first embodiment of FIGS. 1–5, as the actuator for intake camshaft 14, an electric actuator 34 is provided at the rear end of cylinder head 11. In the shown embodiment, although the electric actuator is used as an actuator for intake camshaft 14, in lieu thereof a hydraulic actuator may be used as the intake-camshaft actuator. In such a case, the hydraulic actuator is generally mounted directly on the cylinder head so as to simplify a hydraulic circuit and to reduce a fluid-flow resistance. This ensures a superior response for operation of the hydraulic actuator. Intake camshaft 14 is driven by actuator 34 so that the intake camshaft can be rotated within a predetermined angular range. Actuator 34 is driven in response to a control signal from a controller (not shown) or an electronic engine control unit (ECU). The controller generally comprises a microcomputer. The controller includes an input/output interface (I/O), memories (RAM, ROM), and a microprocessor or a central processing unit (CPU). The input/output interface (I/O) of the controller receives input information from various engine/vehicle switches and sensors, namely a crank angle sensor, an airflow meter, an engine coolant temperature sensor, and the like. Within the controller, the central processing unit (CPU) allows the access by the I/O interface of input informational data signals from the previously-discussed engine/vehicle sensors. The CPU of the controller determines the current engine operating condition based on the input information, and is responsible for carrying the variable valve timing and valve lift characteristic control program stored in memories and is capable of performing necessary arithmetic and logic operations. Computational results (arithmetic calculation results), that is, calculated output signals (containing an electric actuator drive current) are relayed via the output interface circuitry of the controller to output stages (containing the actuator 34).

The valve operating device of the first embodiment shown in FIG. 1 operates as follows.

Figure 6:
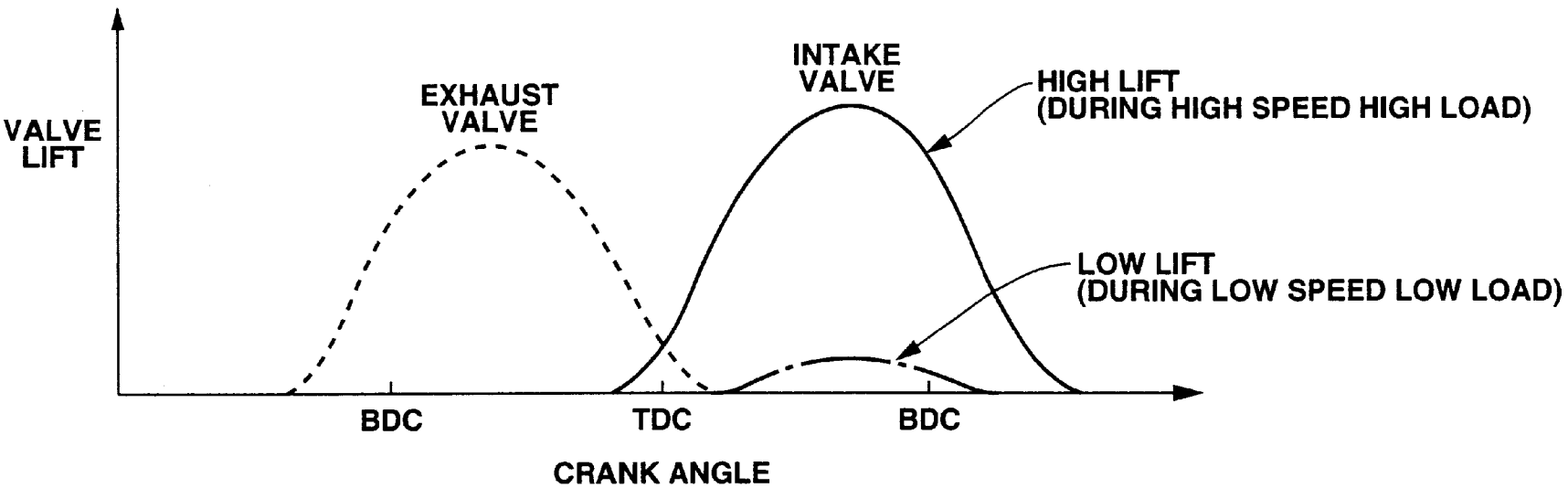
FIG. 6 is a graph illustrating valve timing and valve lift characteristic curves of intake and exhaust valves, in the valve operating device of the invention.

Each of drive cams (18, 18) is driven by exhaust camshaft 15. As each of the drive cams revolves, the associated valve lifter 17 follows the cam surface of drive cam 18 by moving up and down. By virtue of the valve spring bias, during rotation of each of drive cams (18, 18), each of exhaust valves (13, 13) is opened and closed. As regards the exhaust valve lift characteristic, the valve operating device of the embodiment exhibits a fixed valve lift characteristic determined by the cam profile of each of the drive cams (see the exhaust valve lift characteristic indicated by the broken line in FIG. 6), irrespective of the engine operating conditions.

Figure 3:
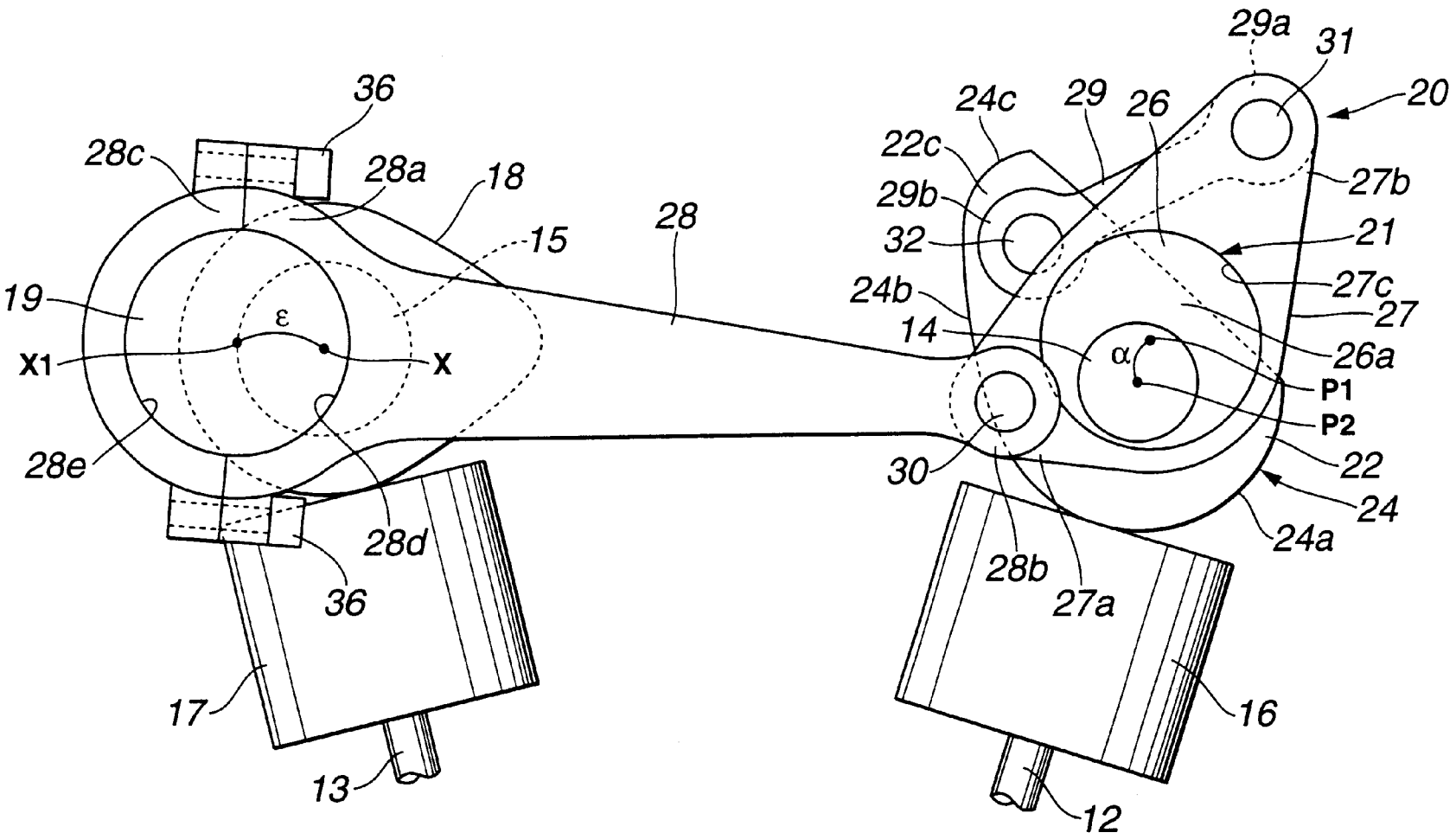
FIGS. 3 through 5 are explanatory views of the operation of the valve operating device of the first embodiment.

On the other hand, each of intake valves (12, 12) is driven as follows. As exhaust camshaft 15 rotates about its axis, first eccentric cam 19 revolves in a circle around the axis of exhaust camshaft 15. Rotary motion (revolution) of first eccentric cam 19 is converted into linear motion of link arm 28. The linear motion of link arm 28 is transmitted via connecting pin 30 to rocker arm 27, and thus rocker arm 27 swings or oscillates around second eccentric cam 26. The oscillating motion of rocker arm 27 is transmitted via link rod 29 to the rockable cam pair (22, 22), so as to produce oscillating motion of the rockable cam pair. By way of the oscillating motion of the rockable cam pair (22, 22), each of intake valves (12, 12) is opened and closed through the respective intake-valve lifters (16, 16). As discussed above, the axis P1 of second eccentric cam 26 eccentrically fixed to intake camshaft 14, that is, the center P1 of oscillating motion of rocker arm 27 is shifted or displaced by controlling the angular position (phase angle) of intake camshaft (control shaft) 14 through actuator 34. By virtue of control mechanism 21, the intake valve lift characteristic can be changed depending on engine operating conditions (see the two different intake valve lift characteristics indicated by the one-dotted line and solid line in FIG. 6). During low-speed and low-load operation, intake camshaft (serving as a control shaft) 14 is driven in its one rotational direction through actuator 34, in response to a control signal from the controller. Then, as shown in FIGS. 1 and 3, the axis P1 of second eccentric cam (control cam) 26 is held at an upper right angular position with respect to the axis P2 (X2) of intake camshaft 14. A radially-thick-walled portion 26*a* of second eccentric cam 26 is shifted or displaced or rotated to the upper right of intake camshaft 14. Owing to the displacement of thick-walled portion 26*a* of second eccentric cam 26, the rocker arm 27 itself is shifted upwards relative to intake camshaft 14. At this time, the cam nose portion 22*c* of rockable cam 22 is slightly displaced or shifted downwards forcibly via link rod 29, and thus the rockable cam pair (22, 22) also rotates leftwards, that is, clockwise (viewing FIGS. 1 and 3). As a result, the abutted area (sliding-contact area) between the upper surface of each intake valve lifter 16 and the lower cam surface of the associated rockable cam 22 and ranging from the base circle portion 24*a* via the intermediate cam surface portion 24*b* to the top circle portion 24*c* forcibly shifts towards the base circle portion 24*a*. In other words, regarding the abutted area (sliding-contact area), the ratio of base circle portion 24*a* to cam surface portion 24*b* tends to increase during low-speed low-load operation. With the rocker arm 27 forcibly shifted upwards, during the low-speed low-load operation, when first eccentric cam 19 revolves by rotation of exhaust camshaft 15 and then the first end 27*a* of rocker arm 27 is pushed through the link arm 28 moving rightwards, the upward displacement (or upward lifting-up force or counterclockwise motion) of first end 27*a* (or pin 30) is transmitted via link rod 29 to rockable cam pair (22, 22), that is, intake-valve lifters (16, 16). In this case, as shown in FIG. 1, a valve lift becomes a comparatively low valve lift L1. As discussed above, during the low-speed low-load operation, as can be seen from the low valve lift characteristic indicated by the one-dotted line in FIG. 6, the valve lift of each of intake valves (12, 12) can be controlled to a comparatively low valve lift. Additionally, the intake valve open timing (IVO) tends to be retarded. The valve overlap (overlapping) of the intake-valve open period and the exhaust-valve open period tends to be decreased. This improves fuel economy and enhances combustion stability of the engine, during low-speed and low-load conditions.

Figure 4:
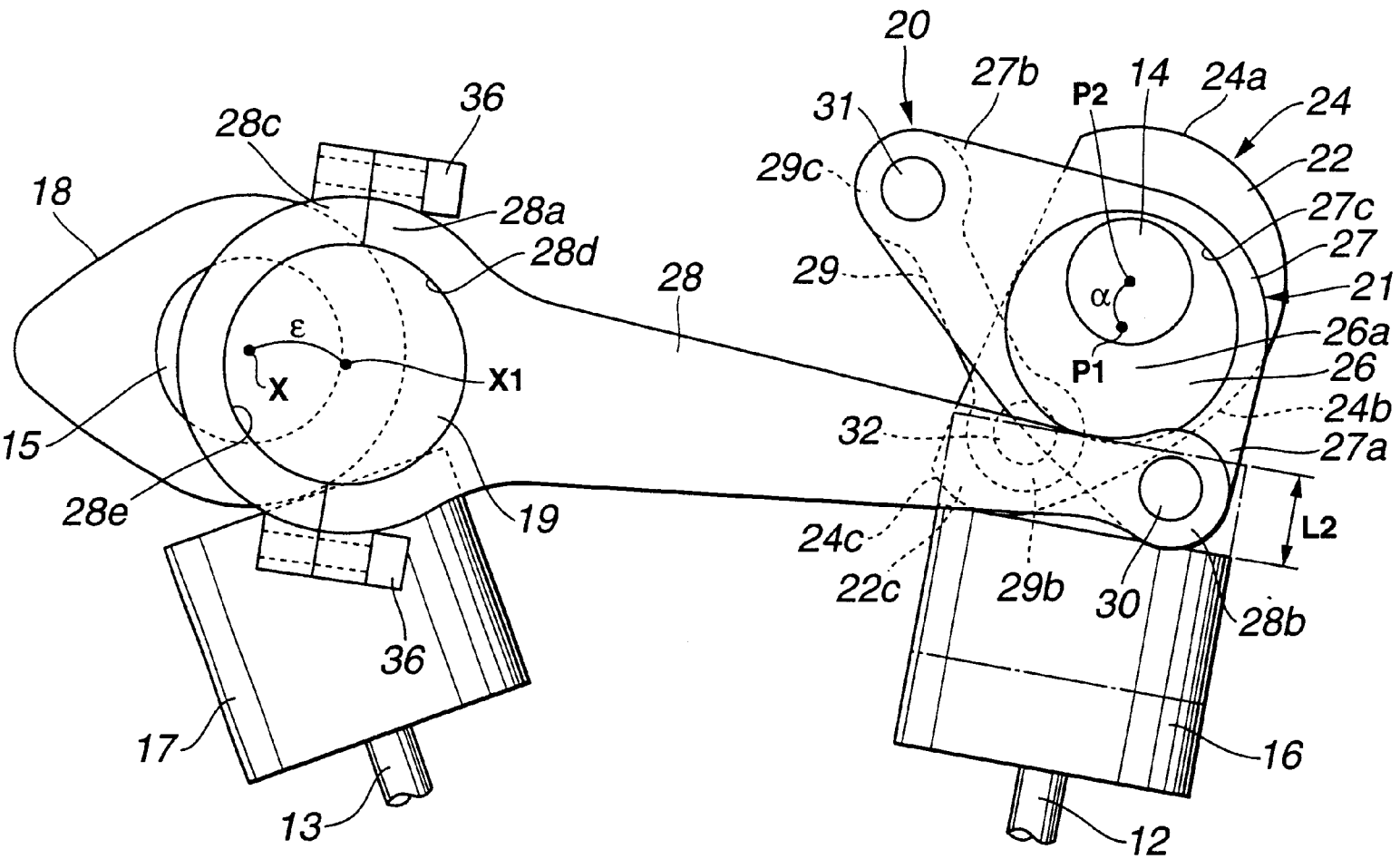
Figure 5:
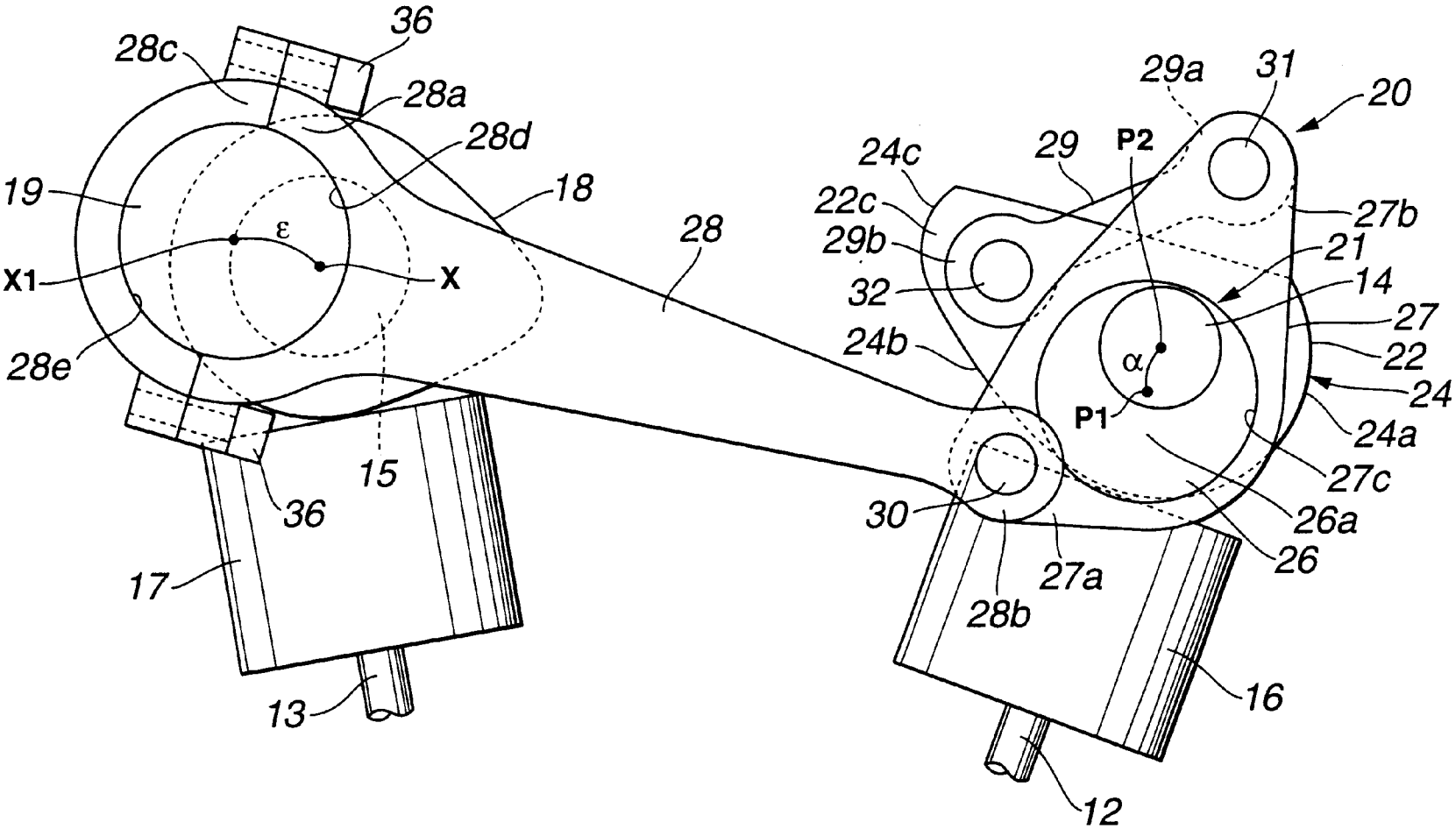

In contrast to the above, when shifting from the low-speed low-load operation to high-speed high-load operation, intake camshaft 14 is driven in the opposite rotational direction through actuator 34, in response to a control signal from the controller. As shown in FIGS. 4 and 5, actually, second eccentric cam 26 is rotated clockwise from the angular position shown in FIG. 1 by the rotary motion of intake camshaft 14. Thus, the axis P1 of second eccentric cam 26 or the thick-walled portion 26*a* of second eccentric cam 26 shifts to the underside of the axis P2 of intake camshaft 14. Thus, the rocker arm 27 itself shifts downwards relative to intake camshaft 14. At this time, the second end 27*b* of rocker arm 27 pushes down the cam nose portion 22*c* of rockable cam 22 via link rod 29, and thus the rockable cam pair (22, 22) also rotates counterclockwise (viewing FIGS. 4 and 5) by a predetermined displacement. As a result, the abutted-position (sliding-contact position) between the upper surface of each intake valve lifter 16 and the lower cam surface of the associated rockable cam 22 shifts rightwards (viewing FIGS. 4 and 5). With the rocker arm 27 shifted downwards, during the high-speed high-load operation, when first eccentric cam 19 revolves by rotation of exhaust camshaft 15 and then the first end 27*a* is pushed through the link arm 28 moving rightwards, the upward displacement (or counterclockwise motion) of first end 27*a* (or pin 30) is transmitted via link rod 29 to rockable cam pair (22, 22), that is, intake-valve lifters (16, 16). In this case, as shown in FIG. 4, a valve lift becomes a comparatively high valve lift L2. As discussed above, during the high-speed high-load operation, as can be seen from the high valve lift characteristic indicated by the solid line in FIG. 6, the valve lift of each of intake valves (12, 12) is controlled to a comparatively high valve lift. Additionally, the intake valve open timing (IVO) tends to be advanced, while the intake valve closure timing (IVC) tends to be retarded. This enhances a charging efficiency of intake air entering the engine cylinders, and thus increases engine power, during high-speed high-load conditions.

As set forth above, in the valve operating device of the first embodiment shown in FIGS. 1-5, the intake valve open timing (IVO) and intake valve closure timing (IVC), and the intake valve lift characteristic (working angle as well as intake valve lift) can be variably controlled. In addition to the above, first eccentric cam 19 is formed as an integral section of exhaust camshaft 15, whereas rockable cam pairs (22, 22; 22, 22; . . . ) and rocker arms (27, 27, . . . ) are oscillatingly provided on intake camshaft 14. As a result of this, it is possible to effectively reduce the height of the valve operating device having the variable valve timing and valve lift characteristic control system, in other words, the overall height of cylinder head 11. Hitherto, an additional cam shaft peculiar to first eccentric cam 19 was required, but in the device of the first embodiment the first eccentric cam can be driven by means of exhaust camshaft 15 generally used as one of engine parts. In addition, intake camshaft 14 is utilized as a control shaft included in a control mechanism as used in the conventional device, and all of the rockable cams (22, 22) and rocker arm 27 are oscillatingly supported on the common intake camshaft. Therefore, it is possible to reduce the height of the valve train installed above cylinder head 11, thus ensuring easier mounting of the valve operating device on internal combustion engines. The engine-hood height can also be reduced. Furthermore, it is possible to reduce the number of component parts of the valve operating device as much as possible. As a consequence, it is possible to enhance a manufacturing efficiency and to reduce total production costs. As can be appreciated from the above, in the device of the first embodiment, the construction of each of intake camshaft 14, exhaust camshaft 15, and their bearing sections (namely, rockable cam brackets 23 and intake-cam bearing caps 40) is not changed. This eliminates the necessity of a design change in cylinder head 11. Thus, the device of the embodiment can be easily mounted on the existing internal combustion engine, thus effectively suppressing an increase in manufacturing costs. Moreover, the second eccentric cam 26 and rocker arm 27 are axially offset from the rockable cam pair (22, 22). The linkage composed of second eccentric cam 26, rocker arm 27 and link arm 28 can be efficiently laid out within a dead space (simply, a space) defined outside of two adjacent drive cams (18, 18) or between two adjacent engine cylinders. Additionally, first eccentric cam 19 is also laid out within the space defined outside of the two adjacent drive cams or between the two adjacent engine cylinders. Thus, it is possible to set the eccentricity E between the axis X1 of first eccentric cam 19 and the axis X of exhaust camshaft 15 to a greater value. In the device of the embodiment, first eccentric cam 19 is mechanically linked to rocker arm 27 through link arm 28, while rocker arm 27 is mechanically linked to rockable cam pair (22, 22) through link rod 29, so as to create a so-called six link structure. Therefore, it is possible to provide an increased rocker arm ratio (an increased leverage) of rocker arm 27, and thus the motion of the input linkage (first eccentric cam 19) can be converted through link arm 28, rocker arm 27 and link rod 29 into a designated output oscillation (a desired oscillation angle) of rockable cam pair (22, 22) without considerably increasing the eccentricity $\epsilon$ of first eccentric cam 19 to exhaust cam 15, in other words, without setting the outside diameter of first eccentric cam 19 to an undesirably great value. As a result, it is possible to easily realize a considerably high valve lift characteristic and also to effectively downsize the device. As discussed above, there is no necessity to set the outside diameter of first eccentric cam 19 to a great value, and therefore it is possible to reduce a sliding-contact surface area between the inner peripheral surface of the annular base portion 28*a* of link arm 28 and the outer peripheral surface of first eccentric cam 19. This contributes to a reduction in frictional resistance at the sliding-contact portion between annular base portion 28*a* and first eccentric cam 19. Also, as described previously, first eccentric cam 19 is formed as an integral section of exhaust camshaft 15. Suppose that first eccentric cam 19 is formed as a separate part. In this case, in order to integrally connect or fit the first eccentric cam to the exhaust camshaft, the mechanical strength of a portion of the first eccentric cam having a minimum wall thickness must be considered sufficiently. In case of first eccentric cam 19 formed as an integral section of exhaust cam 15, it is possible to provide a comparatively great eccentricity without remarkably increasing the outside diameter of first eccentric cam 19. This also contributes to the oscillation-angle enlarging effect of rockable cam pair (22, 22). As set forth above, according to the linkage arrangement of the first embodiment, it is possible to provide the increased oscillation angle of rockable cam pair (22, 22) and thus to effectively increase the ramp section of rockable cam 22. Such an increased ramp section effectively lessens the collision velocity between valve lifter 16 and rockable cam 22, thereby reducing noise and vibrations. Also, rockable cam 22 is oscillated or swung rightwards and leftwards forcibly by rocker arm 27 through link rod 29. There is no necessity of a return spring used in the conventional device.

Thus, it is possible to prevent an increase in friction created by a reaction force of the return spring. By driving only the exhaust camshaft by means of the engine crankshaft, exhaust valves 13 and intake valves 12 can be opened and closed. A structure of a wrapping power-transmission member such as a drive chain wound on the crankshaft and exhaust camshaft 15 can be simplified. This enhances a manufacturing efficient of the device, thus lowering production costs.

Figure 7:
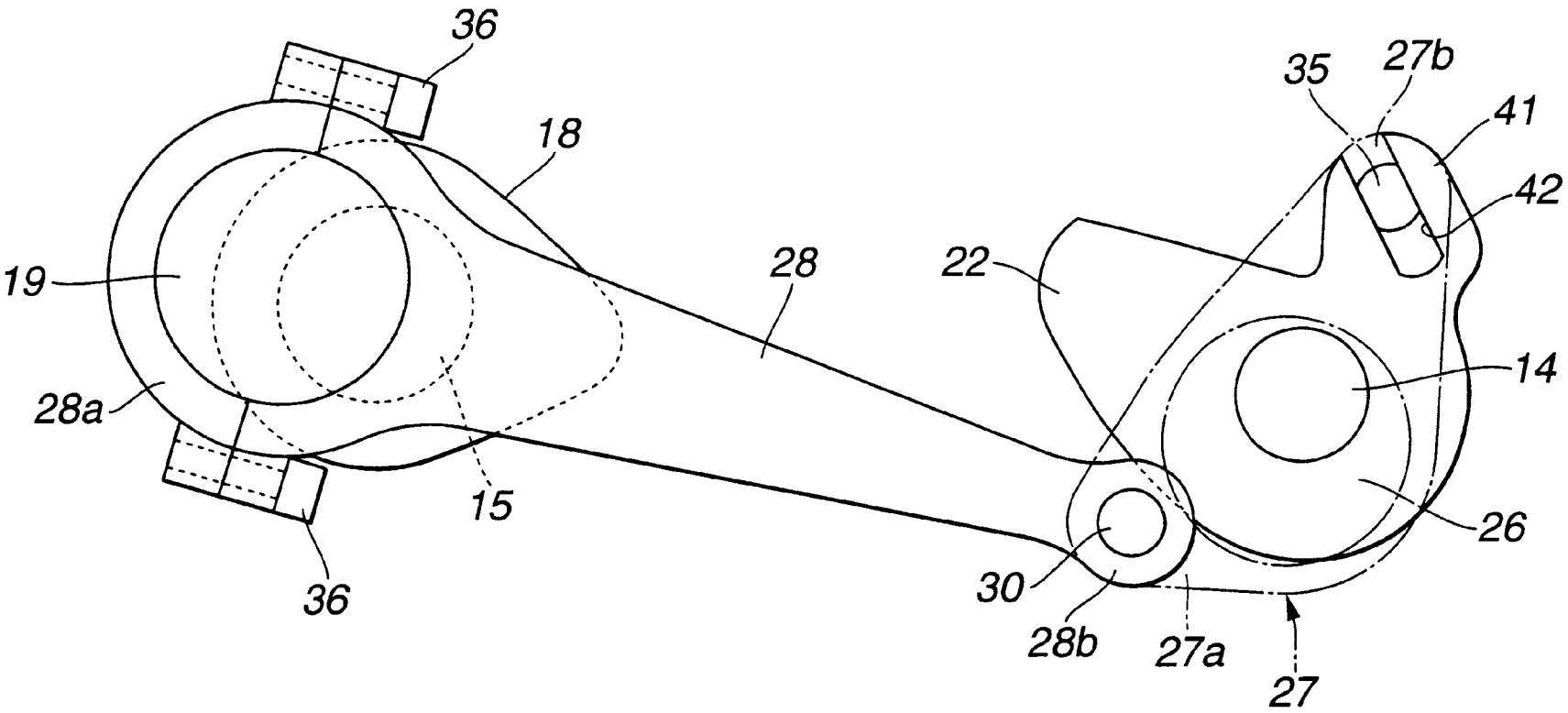
FIG. 7 is a cross-sectional view showing the essential part of a second embodiment of a valve operating device.

Referring now to FIG. 7, there is shown the valve operating device of the second embodiment. The device of the second embodiment of FIG. 7 is different from that of the first embodiment of FIG. 1, in that a protruded portion (or a driving pin or a sliding pin) 35 having width across flats (two parallel flat faces) is provided at the other end 27*b* of rocker arm 27 and a cam slot (or a slit) 42 is provided at a boss-shaped portion 41 formed at the rightmost end (the upper end in FIG. 7) of base circle portion 24*a* of rockable cam 22, instead of using the link rod 29. With the linkage arrangement (the pin-slot engagement) shown in the right-hand side of FIG. 7, during the oscillating motion of rocker arm 27, the protruded portion 35 serves to directly drive or oscillate rockable cam 22, while sliding in the cam slot 42. This enhances a power-transmission efficiency, reduces the number of component parts, and also simplifies the linkage structure.

Figure 8:
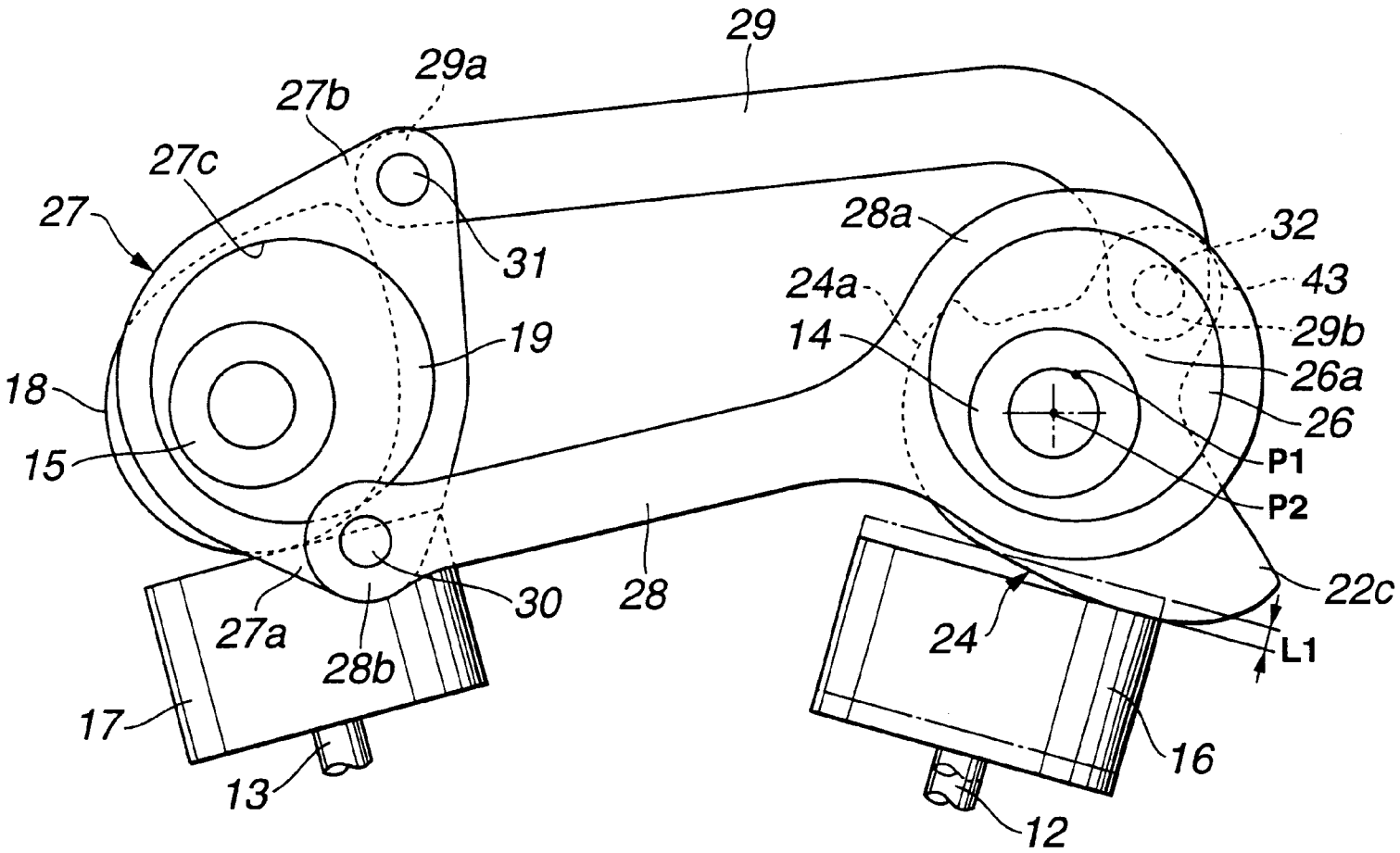
FIG. 8 is a cross-sectional view showing the essential part of a third embodiment of a valve operating device.
Figure 9:
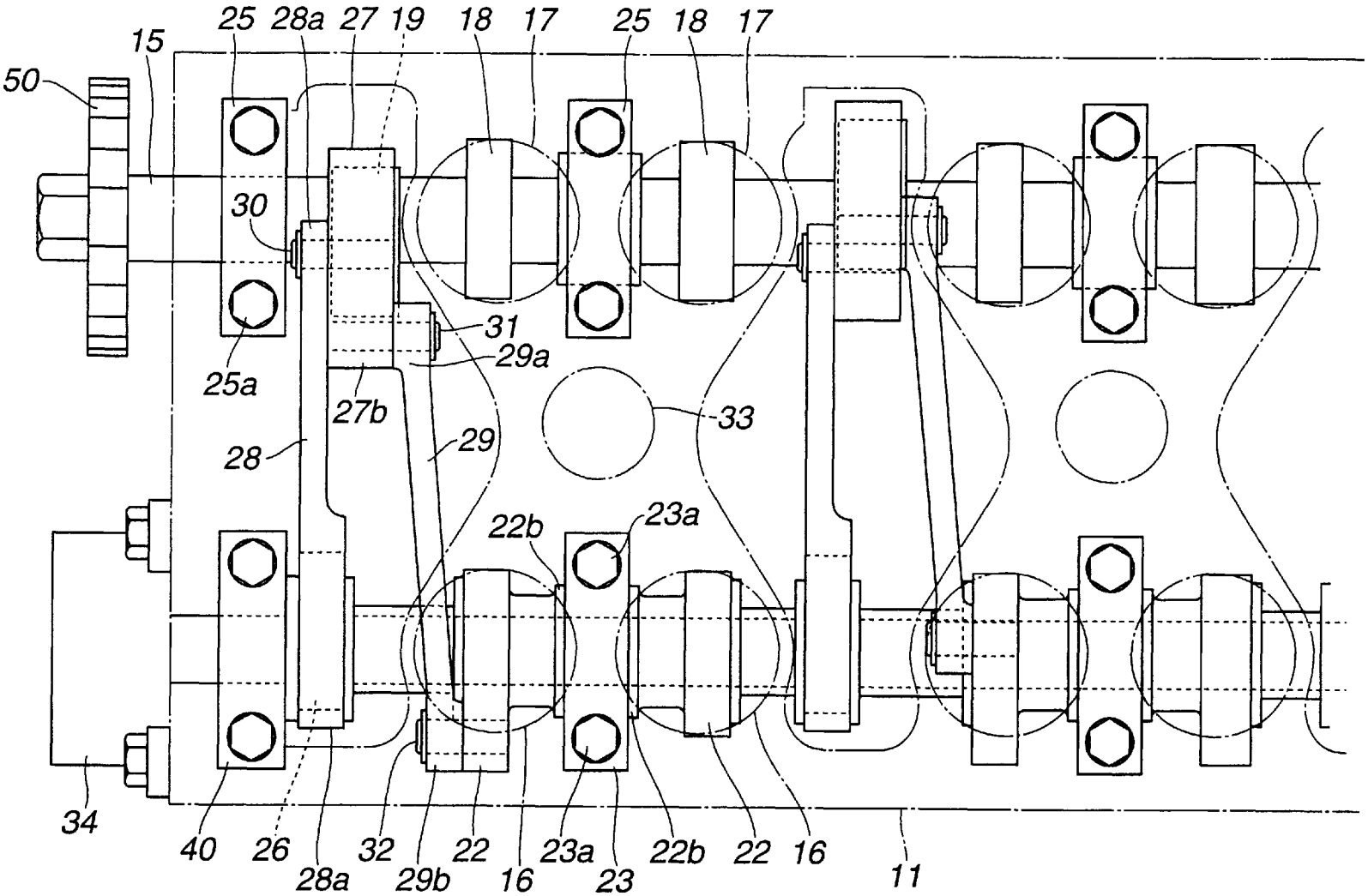
FIG. 9 is a plan view showing the essential part of the valve operating device of the third embodiment.
Figure 10:
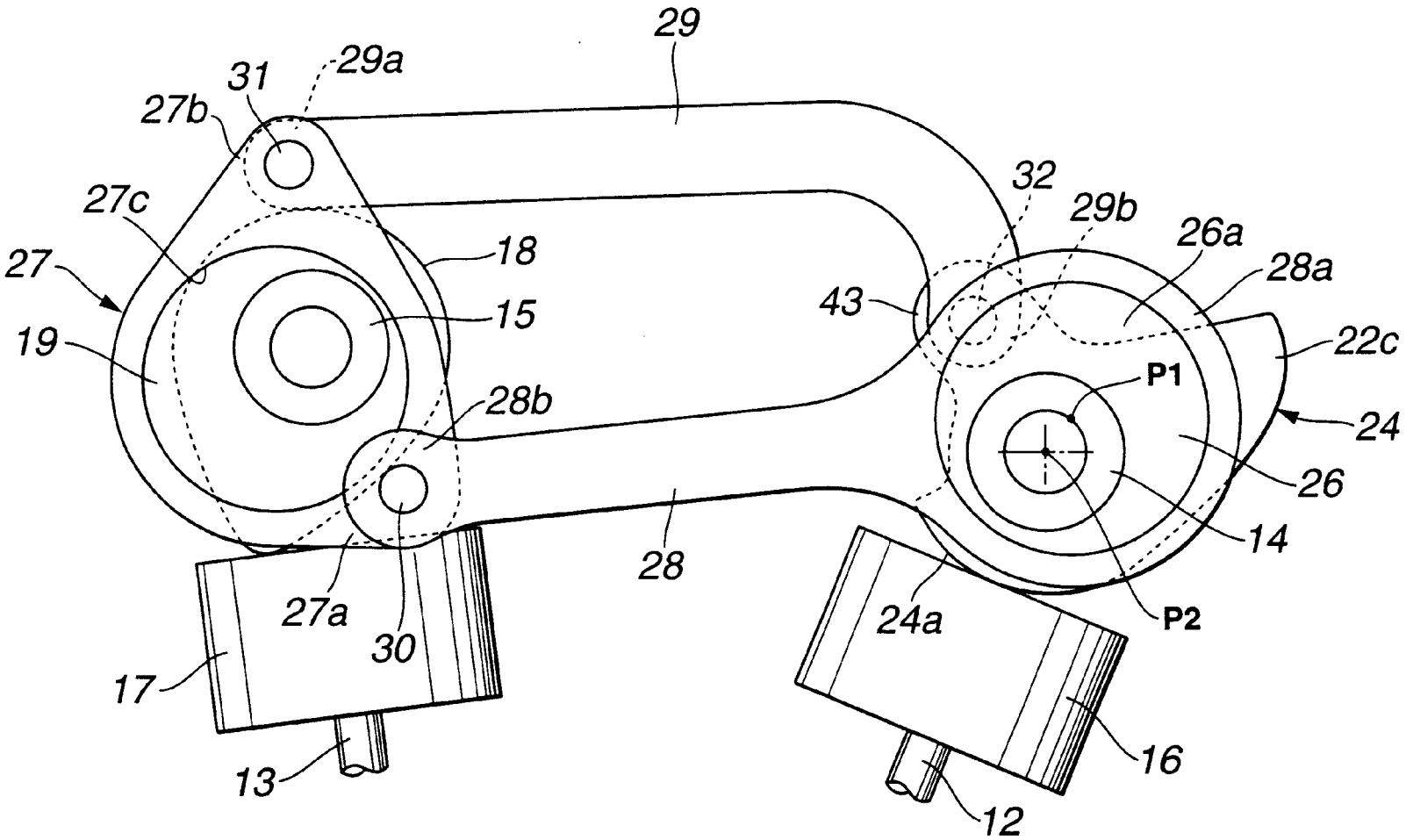
FIGS. 10 through 12 are explanatory views of the operation of the valve operating device of the third embodiment.
Figure 11:
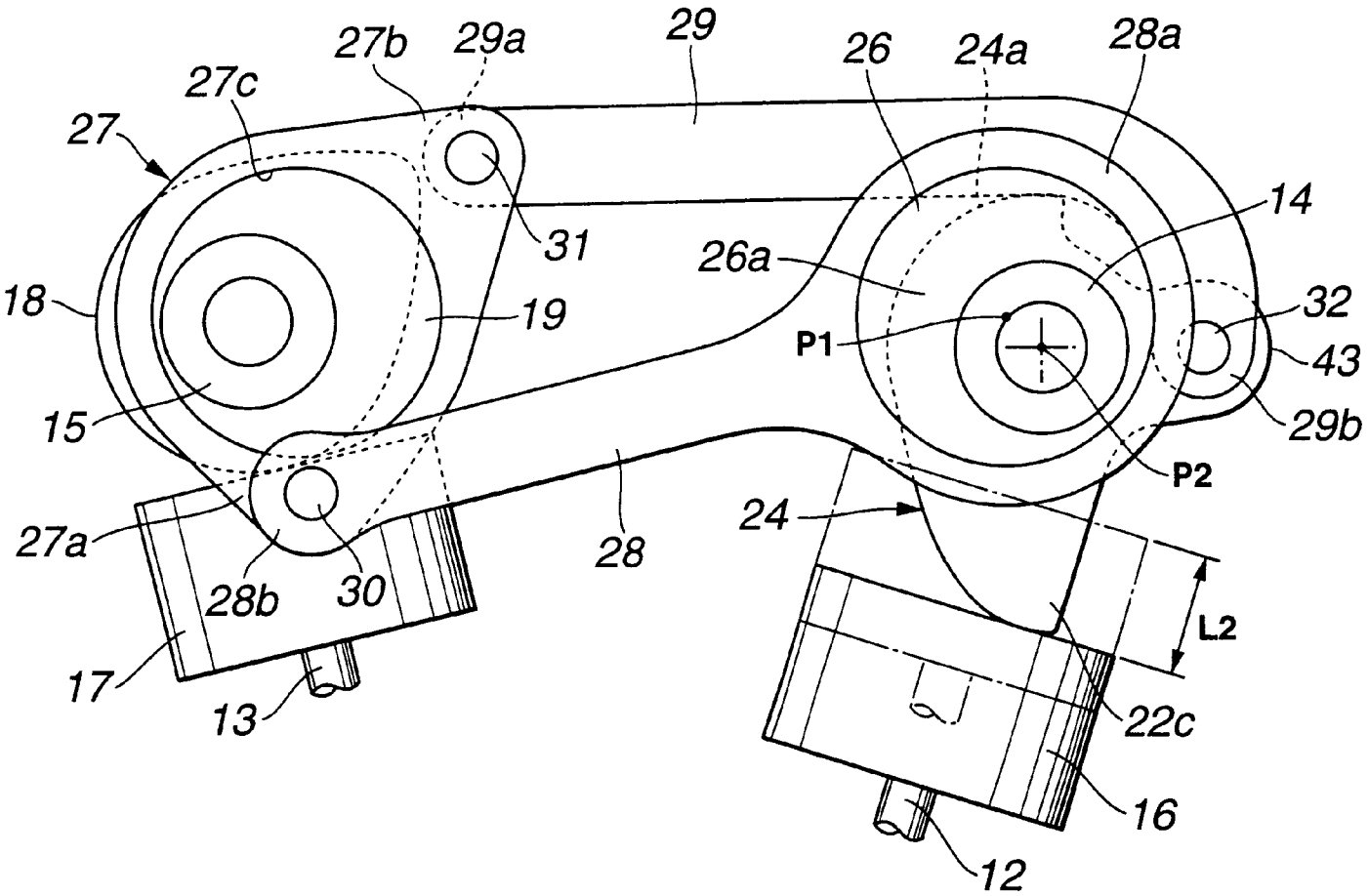

Referring now to FIGS. 8–12, there is shown the valve operating device of the third embodiment. Exhaust camshaft 15 to which the rotational force (torque) of the engine crankshaft is transmitted through a sprocket 50, is not crank-shaped, but formed rectilinearly. First eccentric cam 19 is circle in shape, and located outside of the two adjacent drive cams (18, 18) or between two adjacent engine cylinders, in such a manner as to be axially space apart from the outside of two adjacent exhaust valve lifters (17, 17). First eccentric cam 19 is fixed to the exhaust camshaft. The device of the third embodiment of FIGS. 8–11 is different from that of the first or second embodiments, in that rocker arm 27 is located at a side of the exhaust camshaft. As shown in FIG. 8, rocker arm 27 is oscillatingly supported on the outer peripheral surface of first eccentric cam 19 through the cam hole 27*c* formed in rocker arm 27. The first end 27*a* of rocker arm 27 is mechanically linked via link arm 28 to second eccentric cam 26 fixed to the intake camshaft 14. On the other hand, the second end 27*b* of rocker arm 27 is mechanically linked via link rod 29 to one of the rockable cam pair (22, 22). As best seen in FIGS. 8, 10 and 11, link rod 29 extends transversely substantially in parallel with link arm 28. The other end or right-hand end 29*b* (viewing FIG. 8) of link rod 29 has a substantially inverted L shape such that the right-hand side link-rod end 29*b* is moderately curved downwards or bent towards the rockable cam 22. As can be appreciated from comparison between the linkage arrangements shown in FIGS. 1 and 8, the rockable cam 22 of the device of FIG. 8 is different from that of FIG. 1, in layout and shape. As clearly shown in FIG. 8, cam nose portion 22*c* of the device of the third embodiment is directed transversely outwards and faced apart from the central plug post. Conversely, cam nose portion 22*c* of the device of the first (see FIG. 1) or second (see FIG. 7) embodiments is directed transversely inwards and faced to the central plug post. Rockable cam 22 is formed at its upper end with a boss-shaped portion 43. The other end 29*b* of link rod is linked and pined to the boss-shaped portion 43 of rockable cam 22 by means of a connecting pin 32. In the first, second and third embodiments, the basic structural design that the angular position of intake camshaft 14 is adjusted or controlled by actuator 34 is the same.

The valve operating device of the third embodiment shown in FIG. 8 operates as follows.

During low-speed low-load operation, intake camshaft 14 is driven in its one rotational direction through actuator 34, in response to a control signal from the controller. Then, as shown in FIGS. 8 and 10, the axis P1 of second eccentric cam 26 is held at an upper right angular position with respect to the axis P2 of intake camshaft 14. Therefore, the thick-walled portion 26*a* of second eccentric cam 26 is upwardly rightwards spaced apart from intake camshaft 14. At this time, rocker arm 27 itself is rotated counterclockwise through the link rod 28, and held at a counterclockwise position, and thus rockable cam pair (22, 22) is rotated to a predetermined counterclockwise position (see FIGS. 8 and 10) through link rod 29. As a result, the abutted area (sliding-contact area) between the upper surface of each intake valve lifter 16 and the lower cam surface of the associated rockable cam 22 and ranging from the base circle portion 24*a* via the intermediate cam surface portion 24*b* to the top circle portion 24*c* slightly shifts towards the base circle portion 24*a*. In other words, regarding the abutted area (sliding-contact area), the ratio of base circle portion 24*a* to cam surface portion 24*b* tends to increase during low-speed low-load operation. As set forth above, during the low-speed low-load operation, when first eccentric cam 19 revolves by rotation of exhaust camshaft 15 and then rocker arm 27 oscillates, the displacement or oscillating motion of rocker arm 27 is transmitted via link rod 29 to rockable cam pair (22, 22), that is, intake-valve lifters (16, 16). In this case, as shown in FIG. 8, a valve lift becomes a comparatively low valve lift L1. For the reasons set out above, in the same manner as the device of the first embodiment, in the device of the third embodiment, during the low-speed low-load operation, as can be seen from the low valve lift characteristic indicated by the one-dotted line in FIG. 6, the valve lift of each of intake valves (12, 12) can be controlled to a comparatively low valve lift. Also, the intake valve open timing (IVO) tends to be retarded. The valve overlap of the intake-valve open period and the exhaust-valve open period tends to be reduced. This improves fuel economy and enhances combustion stability, during low-speed and low-load conditions.

Figure 12:
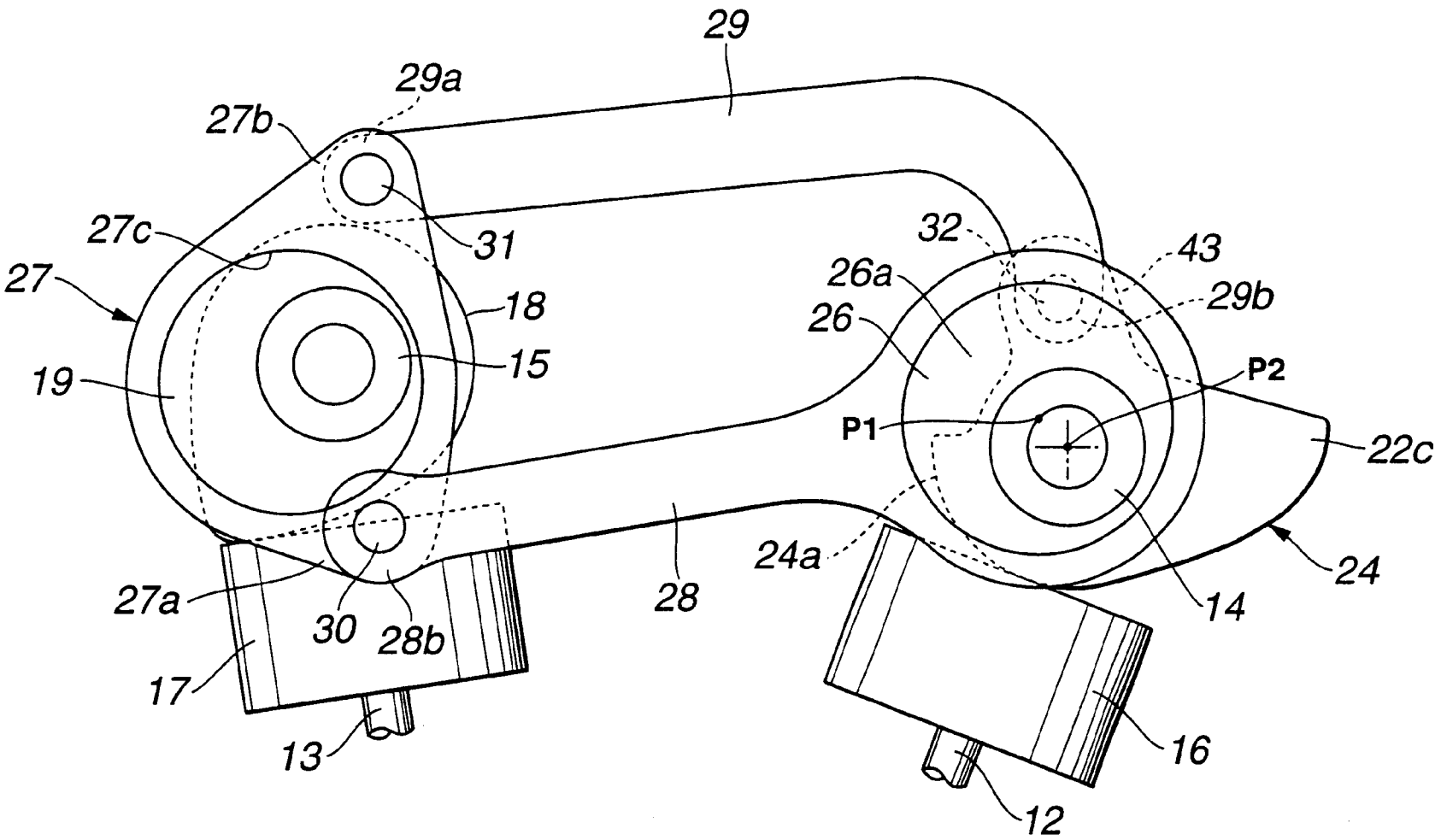

When shifting from the low-speed low-load operation to high-speed high-load operation, intake camshaft 14 is driven in the opposite rotational direction through actuator 34, in response to a control signal from the controller. As shown in FIGS. 11 and 12, actually, second eccentric cam 26 is rotated counterclockwise from the angular position shown in FIG. 8 by the rotary motion of intake camshaft 14. Thus, the axis P1 of second eccentric cam 26 or the thick-walled portion 26*a* of second eccentric cam 26 shifts to the upper left angular position with respect to the axis P2 of intake camshaft 14. Thus, the first end 27*a* of rocker arm 27 is slightly pushed out by link arm 28, and as a result rocker arm 27 itself is rotated clockwise through the link rod 28, and held at a clockwise position. Rockable cam pair (22, 22) is thus rotated to a predetermined clockwise position (see FIGS. 11 and 12) through link rod 29. As a result, the abutted area (sliding-contact area) between the upper surface of each intake valve lifter 16 and the lower cam surface of the associated rockable cam 22 and ranging from the base circle portion 24*a* via cam surface portion 24*b* to top circle portion 24*c* slightly shifts towards the cam nose portion 24*c*. In other words, regarding the abutted area (sliding-contact area), the ratio of base circle portion 24*a* to cam surface portion 24*b* tends to decrease during high-speed high-load operation. As set forth above, during the high-speed high-load operation, when first eccentric cam 19 revolves by rotation of exhaust camshaft 15 and then the first end 27*a* of rocker arm 27 is pushed out through link arm 28, as shown in FIG. 11, a valve lift becomes a comparatively high valve lift L2. Therefore, during the high-speed high-load operation, as can be seen from the high valve lift characteristic indicated by the solid line in FIG. 6, the valve lift of each of intake valves (12, 12) is controlled to a comparatively high valve lift. Additionally, the intake valve open timing (IVO) tends to be advanced, while the intake valve closure timing (IVC) tends to be retarded. This enhances a charging efficiency of intake air entering the engine cylinders, and thus increases engine power. As discussed above, the device of the third embodiment shown in FIGS. 8–12 can provide the same effects (that is, good engine performance suited to various engine operating conditions, such as low-speed low-load operation, high-speed high-load operation and the like, and reduced height of the valve operating device or reduced overall height of cylinder head 1) as the device of the first embodiment shown in FIGS. 1–5.

In the first, second and third embodiments described previously, although the cam profiles of two adjacent rockable cams (22, 22) for the intake valve pair (12, 12) are the same, a cam profile of one of the rockable cams (22, 22) may be different from a cam profile of the other, so as to provide a valve-lift difference between the two intake valves (12, 12) for each engine cylinder. Due to the valve-lift difference, swirl flow in each engine cylinder can be effectively strengthened, thereby improving the combustibility of the engine. In the first, second and third embodiments discussed above, as can be appreciated from the characteristic curves shown in FIG. 6, in order to mainly vary valve timing and valve lift characteristics of intake valves (12, 12), the second camshaft to which at least first eccentric cams 19 are attached is set or used as an exhaust camshaft 15, whereas the first camshaft to which at least rockable cams 22 and rocker arms 27 are attached is set or used as an intake camshaft 14. Alternatively, in order to mainly vary valve timing and valve lift characteristics of exhaust valves (13, 13), the second camshaft to which at least first eccentric cams 19 are attached may be set or used as an intake camshaft 14, whereas the first camshaft to which at least rockable cams 22 and rocker arms 27 are attached may be set or used as an exhaust camshaft 15.

Figure 13:
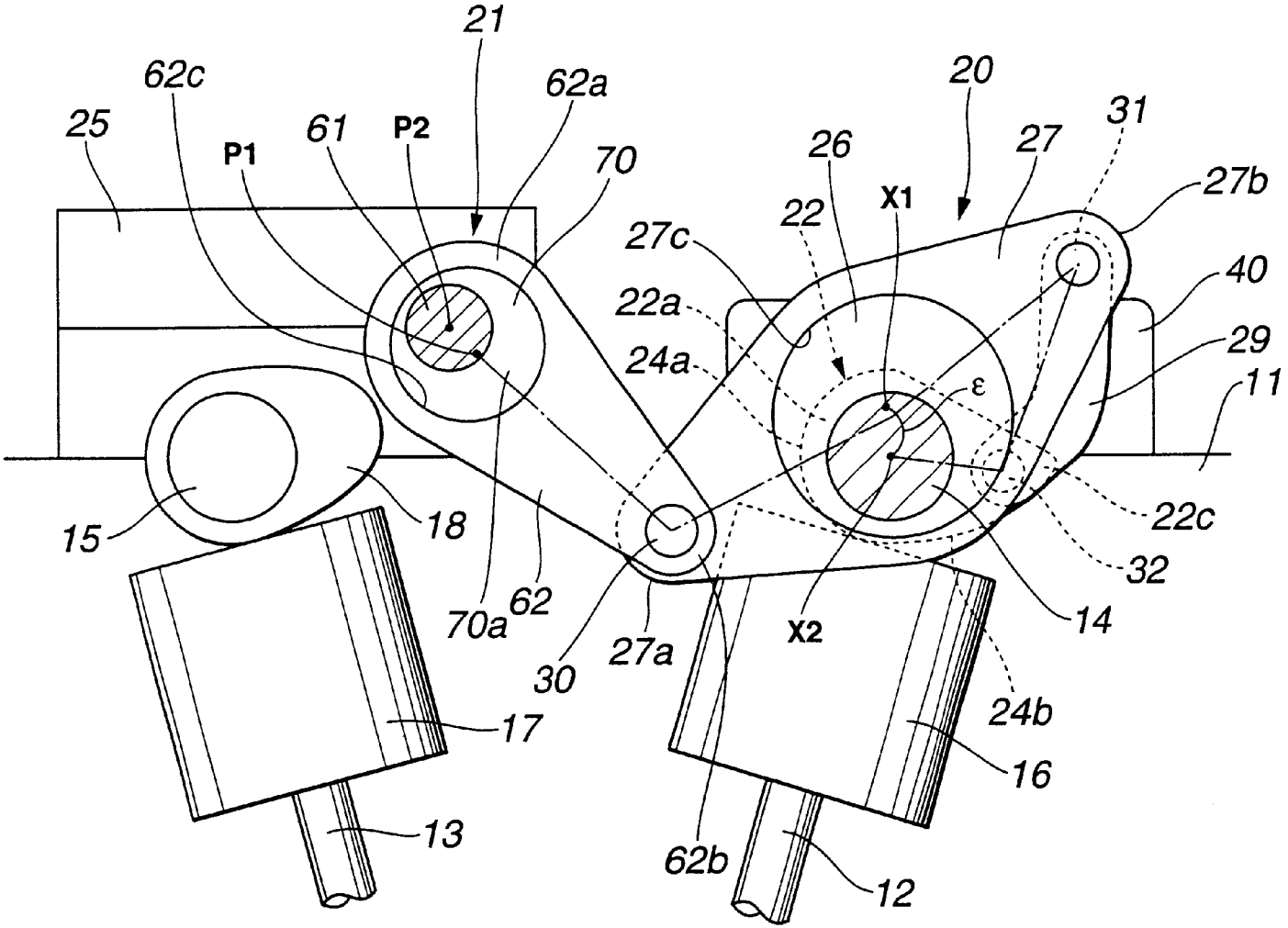
FIG. 13 is a cross-sectional view showing the essential part of a fourth embodiment of a valve operating device.
Figure 14:
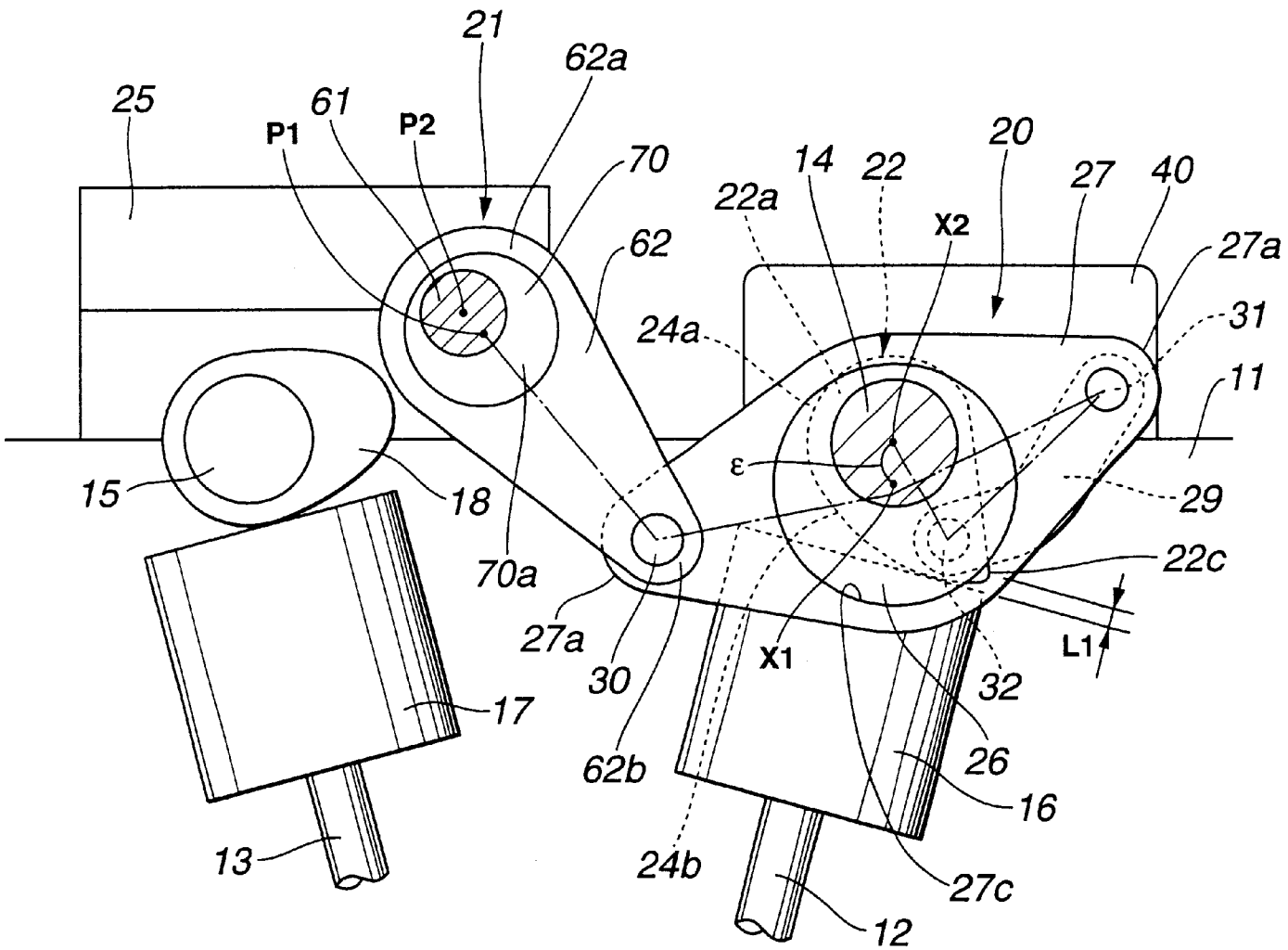
FIG. 14 is an explanatory view showing the operation of the valve operating device of the fourth embodiment, during low valve lift.

Referring now to FIGS. 13 through 16, there is shown the valve operating device of the fourth embodiment. The device of the fourth embodiment is exemplified in an internal combustion engine with one intake valve 12 and one exhaust valve 13 for each engine cylinder. The device of the fourth embodiment of FIGS. 13–16 is similar to the device of the first embodiment of FIGS. 1–5. Thus, the same reference signs used to designate elements in the first embodiment shown in FIGS. 1–5 will be applied to the corresponding reference signs used in the device of the fourth embodiment in FIGS. 13–16, for the purpose of comparison of the first and fourth embodiments. The valve operating device of the fourth embodiment is mounted on cylinder head 11. An intake-valve lifter 16 and an exhaust-valve lifter 17 are provided on upper ends of valve stems of intake and exhaust valves 12 and 13. Each of valve lifters (16, 17) is constructed as a direct-operated valve lifter which is directly operated by means of a cam (that is, drive cam 18 for exhaust-valve lifter 17 and rockable cam 22 for intake-valve lifter 16). Each of the valve lifters has a cylindrical bore closed at its upper end. Valve lifters (16, 17) are slidably accommodated in respective cylindrical valve-lifter supporting bores formed in cylinder head 11. Intake valve 12 and exhaust valve 13 are supported or guided by means of respective valve guides located on both sides of cylinder head 11. Intake camshaft 14 and exhaust camshaft 15 are laid out at the upper portion of cylinder head 11. Inlet and outlet camshafts 14 and 15 are arranged parallel to each other so that their axes extend in the longitudinal direction of the engine. Drive cam 18 is fixed to the exhaust camshaft 15 for opening exhaust valve 13 against the exhaust valve spring bias. Rockable cam 22 is oscillatingly supported on the intake camshaft 14 for opening intake valve 12 against the intake valve spring bias. Power-transmission mechanism (simply, a converter) 20 is provided to transmit an input motion (rotary motion) of second eccentric cam 26 to rockable cam 22, while converting the rotary motion of second eccentric cam 26 to oscillating motion (output motion). Control mechanism 21 is provided for variably controlling a valve lift of intake valve 12 by controlling the attitude of power-transmission mechanism 20, thus shifting or changing the sliding-contact position of rockable cam 22 relative to the associated intake valve 12 (exactly, the associated intake-valve lifter 16). The valve operating device of the fourth embodiment is comprised of the intake valve 12, exhaust valve 13, intake camshaft 14, exhaust camshaft 15, drive cam 18, rockable cam 22, power-transmission mechanism (rotary-to-oscillating motion converter) 20, and control mechanism 21. A rotational force (torque) of the engine crankshaft is transmitted through driven sprockets (not shown) and a timing chain (not shown) located at the front end of the engine to intake and exhaust camshafts 14 and 15. Exhaust-cam bearing caps 25 are bolted to the upper end of cylinder head 11, and thus the upper bearing halves of exhaust-cam bearing caps 25 are fitted to half-round sections of cylinder head 11. Then, the bores in the cylinder head and caps 25 are bored to take the exhaust-cam bearings. In this manner, exhaust camshaft 15 is rotatably supported by way of the exhaust-cam bearings. In a similar manner, intake-cam bearing caps 40 are bolted to the upper end of cylinder head 11, and thus the upper bearing halves of intake-cam bearing caps 40 are fitted to half-round sections of cylinder head 11. Then, the bores in the cylinder head and caps 40 are bored to take the intake-cam bearings. In this manner, intake camshaft 14 is rotatably supported by way of the intake-cam bearings. Exhaust camshaft 15 is integrally formed with drive cam 18 by which exhaust valve 13 is opened or closed via exhaust-valve lifter 17 (see the left-hand side of FIG. 13). The drive cam is formed as a substantially raindrop-shaped circular cam (often called as a "convex cam") in which a top circle and a base circle are joined by a third circular arc. The outer peripheral surface (cam contour surface) of drive cam 18 is in sliding-contact with the upper surface of the associated exhaust valve lifter. Second eccentric cam 26 is fixed to the outer periphery of intake camshaft 14 (see the right-hand side of FIG. 13). In the device of the fourth embodiment, second eccentric cam 26 constructs part of power-transmission mechanism 20. Second eccentric cam 26 is located between two adjacent engine cylinders. Intake camshaft 14 rotatably or oscillatingly supports rockable cam 22 by which intake valve 12 is opened or closed via the intake-valve lifter 16. As shown in FIGS. 13 and 14, rockable cam 22 is formed into a substantially U shape (in side view). Rockable cam 22 is formed at its substantially cylindrical base portion 22*a* with an axially-extending supporting bore into which intake camshaft 14 is rotatably inserted and fitted. A cam nose portion 22*c* extends obliquely upwards from base portion 22*a*. Cam nose portion 22*c* is formed with a connecting-pin hole (simply, a pin hole). As can be seen from the cross-sectional view of FIG. 13, rockable cam 22 is formed on its lower surface with a base circle portion 24*a*, an intermediate cam surface portion 24*b* (simply, a cam surface portion), and a top circle portion. Cam surface portion 24*b* is circular-arc shaped and extends from base circle portion 24*a* to top circle portion. Rockable cam 22 is designed to be brought into abutted-contact with a designated point or a designated position of the upper surface of the associated intake-valve lifter 16 depending on an angular position of rockable cam 22 oscillating. As can be appreciated from the cross sections shown in FIGS. 13–16, a predetermined angular range of base circle portion 24*a* functions as a base circle section. A predetermined angular range of the cam surface portion 24*b* being continuous with the base circle portion 24*a* functions as a ramp section. A predetermined angular range of the top circle portion or the cam nose portion 22*c* being continuous with the ramp section of cam surface portion 24*b* functions as a lift section. Power-transmission mechanism 20 of the device of the fourth embodiment is comprised of the second eccentric cam 26, rocker arm 27 oscillatingly supported on the outer periphery of the second eccentric cam, and link rod 29 mechanically linking the second end 27*b* of rocker arm 27 and the cam nose portion 22*c* of rockable cam 22. Second eccentric cam 26 is substantially disc-shaped. As shown in FIG. 13, second eccentric cam 26 is offset from intake camshaft 14, so that the axis X1 of second eccentric cam 26 is eccentric to the axis X2 of intake camshaft 14 by an eccentricity $\epsilon$. On the other hand, as shown in FIG. 13, rocker arm 27 is formed into a substantially boomerang shape in such a manner as to extend in the transverse direction of the engine. Rocker arm 27 is dimensioned to be comparatively short in length. A substantially central portion of rocker arm 27 is bored as a cam hole 27*c*, and thus rocker arm 27 is oscillatingly or rockably supported on second eccentric cam 26 rotatably fitted into the cam hole 27*c*. Rocker arm 27 is formed at its first end 27*a* with a connecting pin hole into which a tip end (or a front end) of a connecting pin 30 is loosely rotatably fitted. The first end 27*a* of rocker arm 27 is connected to a control arm 62 (described later) by means of the connecting pin 30. Additionally, rocker arm 27 is formed at its second end 27*b* with a connecting pin hole into which a connecting pin 31 is press-fitted. The second end 27*b* of rocker arm 27 is connected to link rod 28 by means of the connecting pin 31. Link rod 29 is formed as a comparatively short, boomerang-shaped link. Link rod 29 is formed on its both ends with a pair of circular portions each having a connecting-pin hole. Pin 31, press-fitted into the connecting-pin hole formed in the second end 27*b* of rocker arm 27, and pin 32, press-fitted into the connecting-pin hole formed in the first end 27*a*, are rotatably inserted into the respective connecting-pin holes of both ends of link rod 29. Snap rings are fitted to the respective tip ends of pins 30, 31 and 32, to prevent these pins from falling out of the respective connecting-pin holes. Control mechanism 21 is comprised of a control shaft 61, a third eccentric cam 70 (serving as a control cam), a control arm 62, and the same actuator as denoted by reference sign 34 in the first embodiment). Control shaft 61 is rotatably supported on the exhaust-cam bearing 25. Third eccentric cam 70 is fixed to control shaft 61. Control arm 62 is provided to mechanically link the third eccentric cam 70 to the first end 27*a* of rocker arm 27. Control shaft 61 is located between intake and exhaust camshafts 14 and 15, and situated close to the exhaust camshaft. Control shaft 61 extends in the longitudinal direction of the engine. Control shaft 61 is driven by the actuator provided at the rear end of cylinder head 11, so that control shaft 61 is rotated within a predetermined angular range. Third eccentric cam 70 is annular in shape. The axis P1 of third eccentric cam 70 is eccentric to the axis P2 of control shaft 61 by a distance $\alpha$. Control arm 62 is formed as a substantially straight link and has a relatively large-diameter portion 62*a* at its one end and a relatively small-diameter portion 62*b* at the other end. The large-diameter portion 62*a* is formed therein a cam hole 62*c* in which third eccentric cam 70 is slidably fitted. On the other hand, the small-diameter portion 62*b* is rotatably connected to the first end 27*a* of rocker arm 27 by means of pin 30.

The valve operating device of the fourth embodiment shown in FIG. 13 operates as follows.

Drive cam is driven by exhaust camshaft 15. As the drive cam revolves, the associated valve lifter 17 follows the cam surface of drive cam 18 by moving up and down. By virtue of the valve spring bias, during rotation of drive cam 18, the exhaust valve is opened and closed. As regards the exhaust valve lift characteristic, the valve operating device of the fourth embodiment exhibits a fixed valve lift characteristic determined by the cam profile of drive cam 18 (see the exhaust valve lift characteristic indicated by the broken line in FIG. 6.), irrespective of the engine operating conditions.

On the other hand, intake valve 12 is driven as follows. As intake camshaft 14 rotates about its axis, second eccentric cam 26 revolves in a circle around the axis of intake camshaft 14. Rotary motion of second eccentric cam 26 is converted into oscillating motion of rocker arm 27. The oscillating motion of rocker arm 27 is transmitted via link rod 29 to rockable cam 22, and thus the rockable cam swings or oscillates around intake camshaft 14. By way of the oscillating motion of rockable cam 22, intake valve 12 is opened and closed through the intake-valve lifter 16. As discussed above, the axis P1 of third eccentric cam 70 eccentrically fixed to control shaft 61 is shifted or displaced by controlling the angular position (phase angle) of control shaft 61 through actuator 34, and as a result the attitude of power-transmission mechanism 20 can be changed. In other words, by changing the angular phase of the axis P1 of third eccentric cam 70 relative to the axis P2 of control shaft 61, the attitude of power-transmission mechanism 20 can be changed and therefore the center of oscillating motion of rocker arm 27, which is rockably or oscillatingly supported on the outer periphery of second eccentric cam 26 so that the center of oscillating motion of rocker arm 27 is capable of revolving in a circle around the axis X2 of intake camshaft 14, is variably controlled by the control shaft 61. By virtue of control mechanism 21, the intake valve lift characteristic can be changed depending on engine operating conditions (see the two different intake valve lift characteristics indicated by the one-dotted line and solid line in FIG. 6). During low-speed and low-load operation, control shaft 61 is driven in its one rotational direction through actuator 34, in response to a control signal from the controller. Then, as shown in FIGS. 13 and 14, the axis P1 of third eccentric cam (control cam) 70 is held at a lower right angular position with respect to the axis P2 of control shaft 61. A radially-thick-walled portion 70*a* of third eccentric cam 70 is shifted or displaced or rotated to the lower right of control shaft 61. Owing to the displacement of thick-walled portion 70*a* of second eccentric cam 70, the first portion 27*a* of rocker arm 27 is pulled down and as a result the rocker arm itself is rotated counterclockwise. At this time, the cam nose portion 22*c* of rockable cam 22 is forcibly pulled upwards via the link rod 29 by the second end 27*b* of rocker arm 27. In this manner, as a whole the right-hand linkage section comprised of rocker arm 27, link rod 29, and rockable cam 22 shifts counterclockwise. As a result, the abutted area (sliding-contact area) between the upper surface of intake-valve lifter 16 and the lower cam surface of the associated rockable cam 22 and ranging from the base circle portion 24*a* via the intermediate cam surface portion 24*b* to the top circle portion slightly shifts towards the base circle portion 24*a* (see FIGS. 13 and 14). In other words, regarding the abutted area (sliding-contact area), the ratio of base circle portion 24*a* to cam surface portion 24*b* tends to increase during low-speed low-load operation. With the rocker arm 27 forcibly shifted counterclockwise, during the low-speed low-load operation, when second eccentric cam 26 revolves by rotation of intake camshaft 14 and thus rocker arm 27 swings or oscillates, the oscillating motion of rocker arm 27 (or upward lifting-up force of second end 27*b* of rocker arm 27) is transmitted via the link rod 29 through rockable cam 22 to intake-valve lifter 16. In this case, as shown in FIG. 14, a valve lift becomes a comparatively low valve lift L1. Therefore, during the low-speed low-load operation, as can be seen from the low valve lift characteristic indicated by the one-dotted line in FIG. 6, the valve lift of intake valve 12 can be controlled to a comparatively low valve lift. Additionally, the intake valve open timing (IVO) tends to be retarded. The valve overlap of the intake-valve open period and the exhaust-valve open period tends to be decreased. This improves fuel economy and enhances combustion stability of the engine, during low-speed and low-load conditions.

Figure 15:
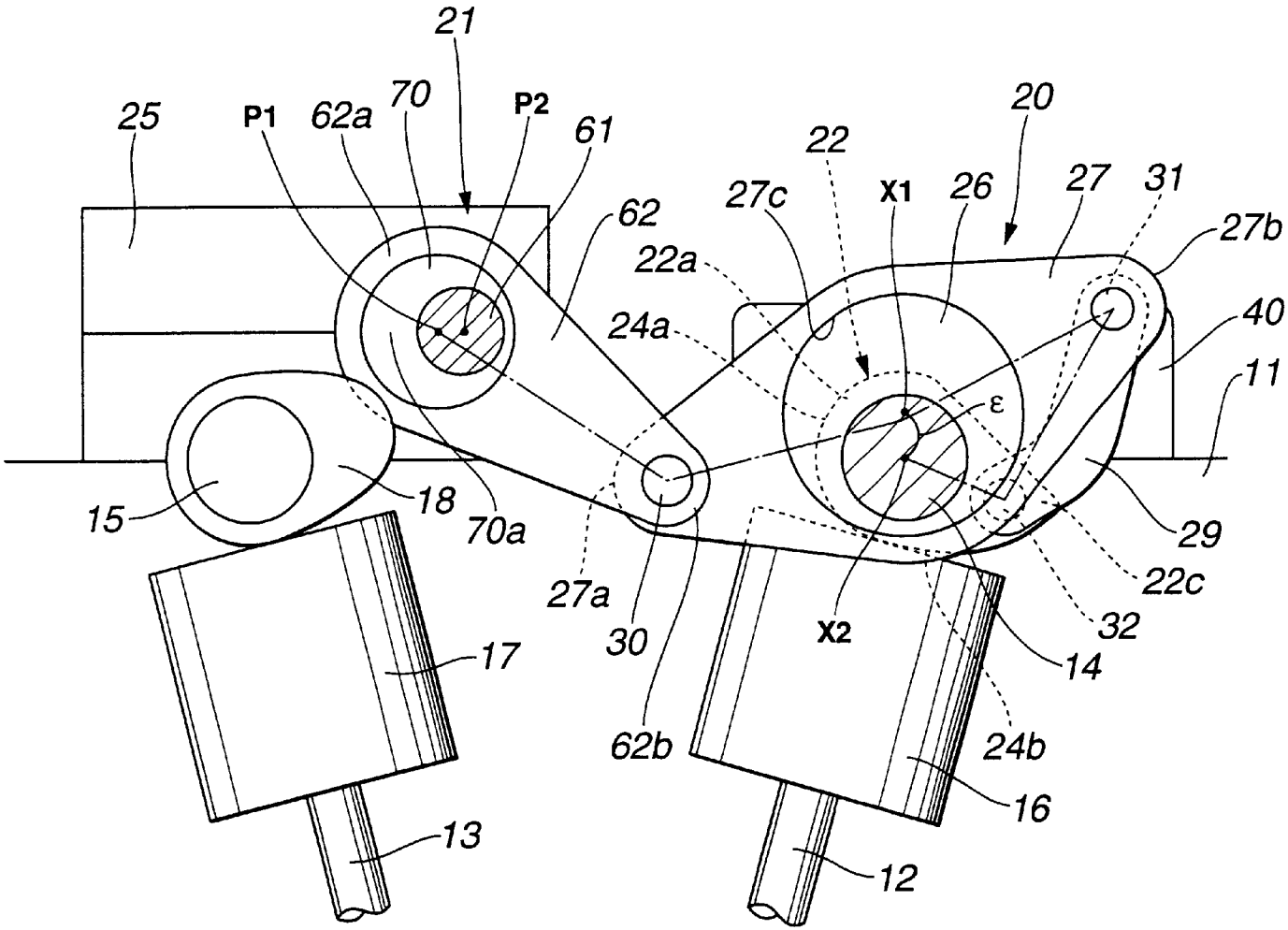
FIGS. 15 and 16 are explanatory views showing the operation of the valve operating device of the fourth embodiment, during high valve lift.
Figure 16:
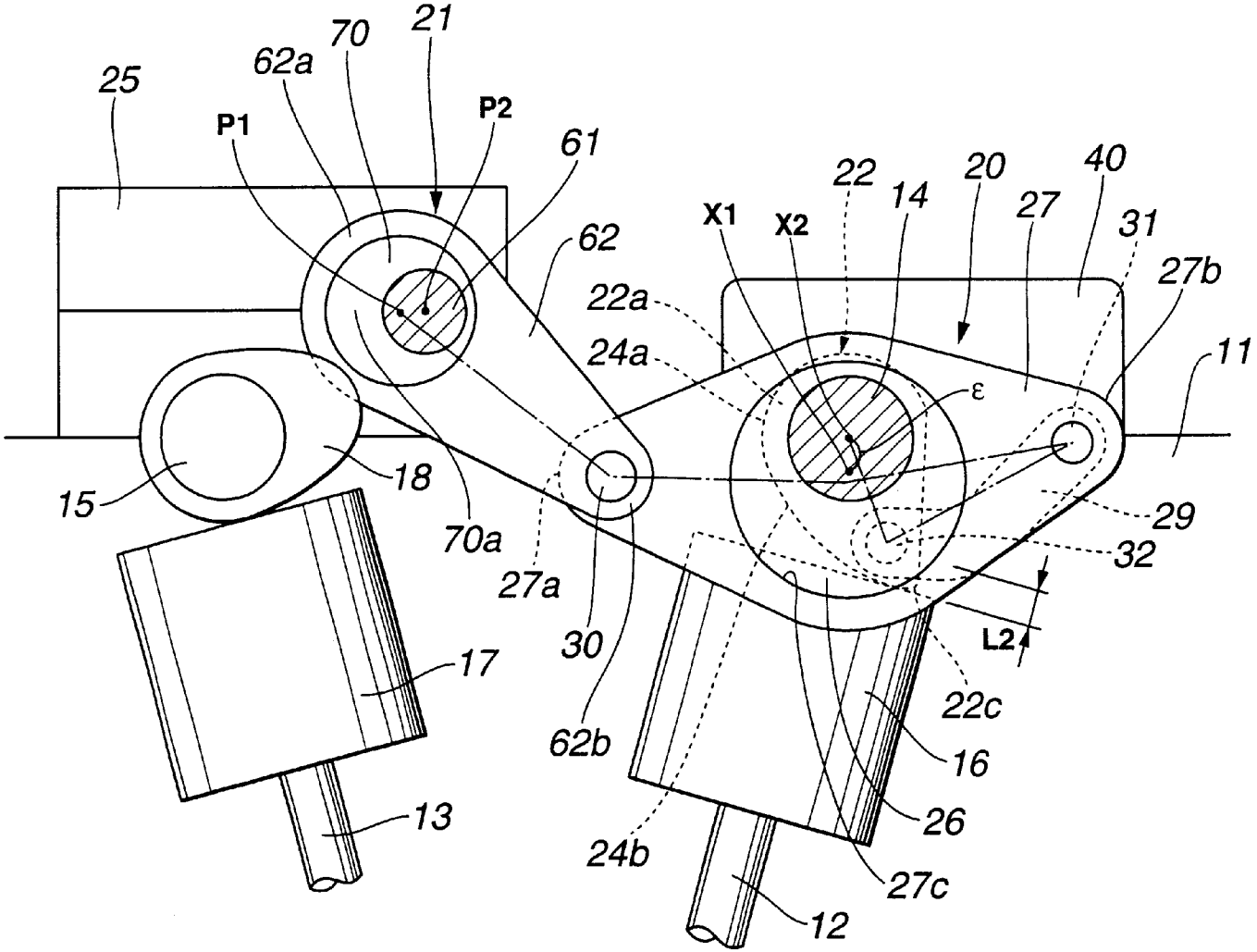

Contrary, when shifting from the low-speed low-load operation to high-speed high-load operation, control shaft 61 is driven in the opposite rotational direction through actuator 34, in response to a control signal from the controller. As shown in FIGS. 15 and 16, actually, control shaft 61 is rotated clockwise and thus third eccentric cam (control cam) 70 is rotated clockwise from the angular position shown in FIGS. 13 and 14. Thus, the axis P1 of third eccentric cam (control cam) 70 or the thick-walled portion 70*a* of third eccentric cam 70 shifts to the upper left (almost to the left) of the axis P2 of control shaft 61. Thus, rocker arm 27 itself rotates clockwise. At this time, the cam nose portion 22*c* of rockable cam 22 is forcibly pulled down via the link rod 29 by the second portion 27*b* of rocker arm 27. In this manner, as a whole, the right-hand linkage section comprised of rocker arm 27, link rod 29, and rockable cam 22 shifts clockwise (note a relatively greater angle between the neutral axis of control arm 62 indicated by the one-dotted line in FIGS. 15 and 16 and the neutral axis of rocker arm 27 indicated by the one-dotted line in FIGS. 15 and 16 as compared to an angle between the neutral axis of control arm 62 indicated by the one-dotted line in FIGS. 13 and 14 and the neutral axis of rocker arm 27 indicated by the one-dotted line in FIGS. 13 and 14). As a result, the abutted area (sliding-contact area) between the upper surface of intake-valve lifter 16 and the lower cam surface of the associated rockable cam 22 and ranging from the base circle portion 24*a* via the intermediate cam surface portion 24*b* to the top circle portion slightly shifts towards the cam surface portion 24*b* (see FIGS. 15 and 16). In otherwords, regarding the abutted area (sliding-contact area), the ratio of base circle portion 24*a* to cam surface portion 24*b* tends to decrease during high-speed high-load operation. With the rocker arm 27 forcibly shifted clockwise, during the high-speed high-load operation, when second eccentric cam 26 revolves by rotation of intake camshaft 14 and thus the second end 27*b* of rocker arm 27 is pushed down via the link rod 29, as shown in FIG. 16, a valve lift becomes a comparatively high valve lift L2. Therefore, during the high-speed high-load operation, as can be seen from the high valve lift characteristic indicated by the one-dotted line in FIG. 6, the valve lift of intake valve 12 can be controlled to a comparatively high valve lift. Additionally, the intake valve open timing (IVO) tends to be advanced, while the intake valve closure timing (IVC) tends to be retarded. This enhances a charging efficiency of intake air entering the engine cylinders, and thus increases engine power, during high-speed high-load conditions.

As discussed above, in the valve operating device of the fourth embodiment shown in FIGS. 13–16, the intake valve open timing (IVO) and intake valve closure timing (IVC), and the intake valve lift characteristic (working angle as well as intake valve lift) can be variably controlled. In addition to the above, second eccentric cam 26 is formed as an integral section of intake camshaft 14, whereas rockable cam 22 and rocker arm 27 are oscillatingly provided on intake camshaft 14. As a result of this, it is possible to effectively reduce the height of the valve operating device having the variable valve timing and valve lift characteristic control system, in other words, the overall height of cylinder head 11. Hitherto, an additional cam shaft peculiar to second eccentric cam 26 was required, but in the device of the fourth embodiment the second eccentric cam can be driven by means of intake camshaft 14 generally used as one of engine parts. In addition, rockable cam 22 and rocker arm 27 are both oscillatingly supported on the common intake camshaft. Therefore, it is possible to reduce the height of the valve train installed above cylinder head 11, thus ensuring easier mounting of the valve operating device on internal combustion engines (including various types of engines, such as V-type engines and in-line engines). The engine-hood height can also be reduced. Furthermore, it is possible to reduce the number of component parts of the valve operating device as much as possible. As a consequence, it is possible to enhance a manufacturing efficiency and to reduce total production costs. Additionally, as can be appreciated from the layout of rocker arm 27 mounted on intake camshaft 14 via second eccentric cam 26 (see FIG. 13), it is possible to arrange control shaft 61 within a space defined between intake and exhaust camshafts 14 and 15 and to locate control shaft 61 closer to the exhaust camshaft, utilizing the exhaust-cam bearings 25. Thus, it is possible to set the installation height of control shaft 61 to a properly low level, and as a result it is possible to adequately reduce the height of the valve train installed above cylinder head 11. Also, in the device of the fourth embodiment, control shaft 61, third eccentric cam (control cam) 70, and control arm 62 are laid out within a dead space (a space) defined between intake and exhaust camshafts 14 and 15, and thus it is possible to efficiently use the dead space. Within the dead space, there are less obstacles that prevent rotary motion (pivotal motion) of each of control shaft 61, third eccentric cam (control cam) 70, and control arm 62. This ensures the enhanced design flexibility (increased operating angle of each of the control shaft 61, control cam 70, and control arm 62, increased eccentricity a between the two axes P1 and P2, and the like). The increased eccentricity a acts to increase or amplify the oscillating motion of rocker arm 27. The increased oscillating motion of rocker arm 27 contributes to a remarkable change in valve lift characteristic. In the same manner as the device of first embodiment, in the device of the fourth embodiment, the construction of each of intake camshaft 14, exhaust camshaft 15, and their bearing sections (namely, rockable cam brackets 23 and intake-cam bearing caps 40) is not changed. This eliminates the necessity of a design change in cylinder head 11. Thus, the device of the embodiment can be easily mounted on the existing internal combustion engine, thus effectively suppressing an increase in manufacturing costs. As set forth above, according to the linkage arrangement of the fourth embodiment, owing to the increased eccentricity $\alpha$, it is possible to provide the increased oscillation angle of rockable cam 22 and thus to effectively increase the ramp section of rockable cam 22. Such an increased ramp section effectively lessens the collision velocity between valve lifter 16 and rockable cam 22, thereby reducing noise and vibrations. Also, rockable cam 22 is oscillated or swung rightwards and leftwards forcibly by rocker arm 27 through link rod 29. There is no necessity of a return spring used in the conventional device. Thus, it is possible to prevent an increase in friction created by a reaction force of the return spring.

Figure 17:
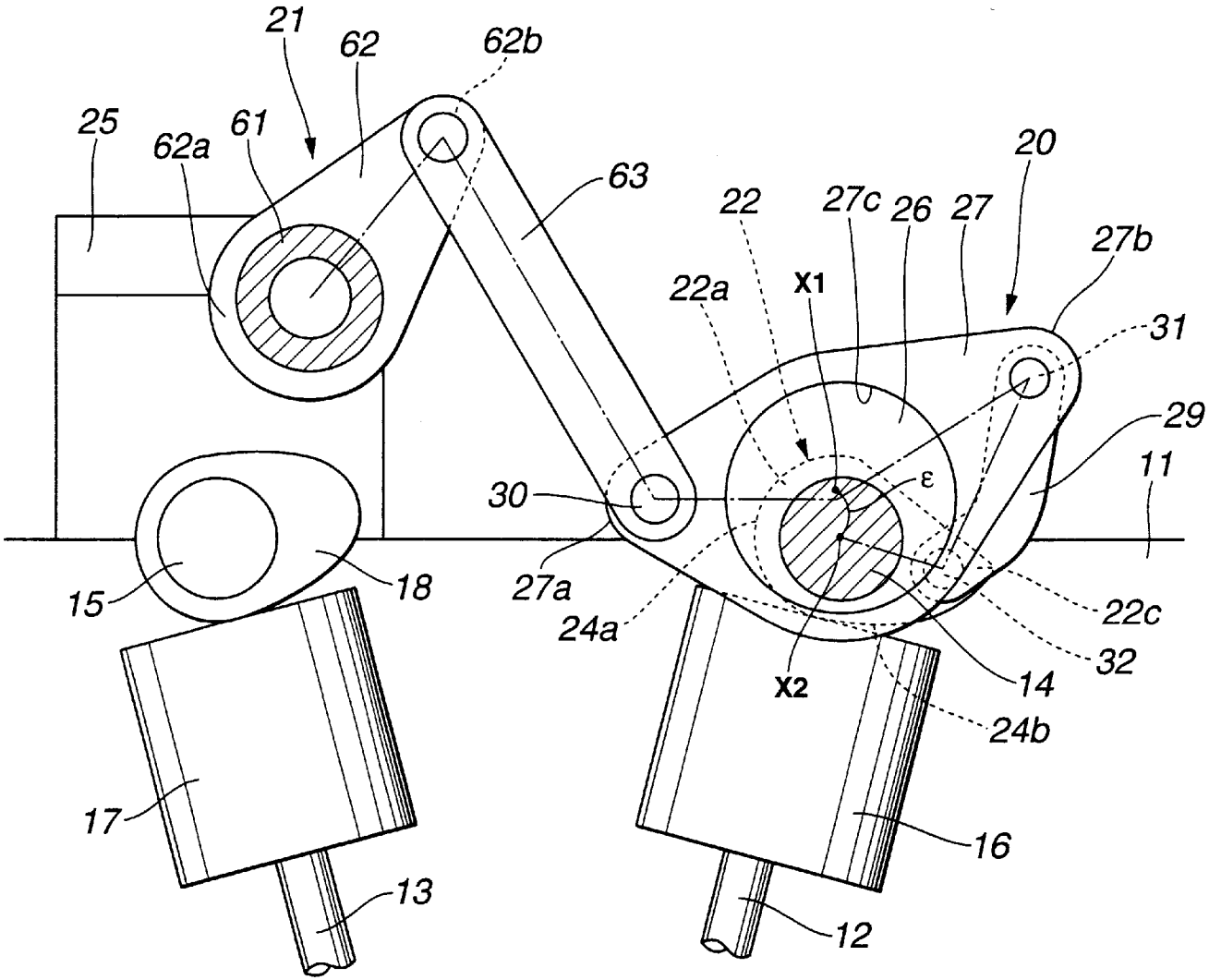
FIG. 17 is a cross-sectional view of the essential part of a fifth embodiment of a valve operating device.
Figure 18:
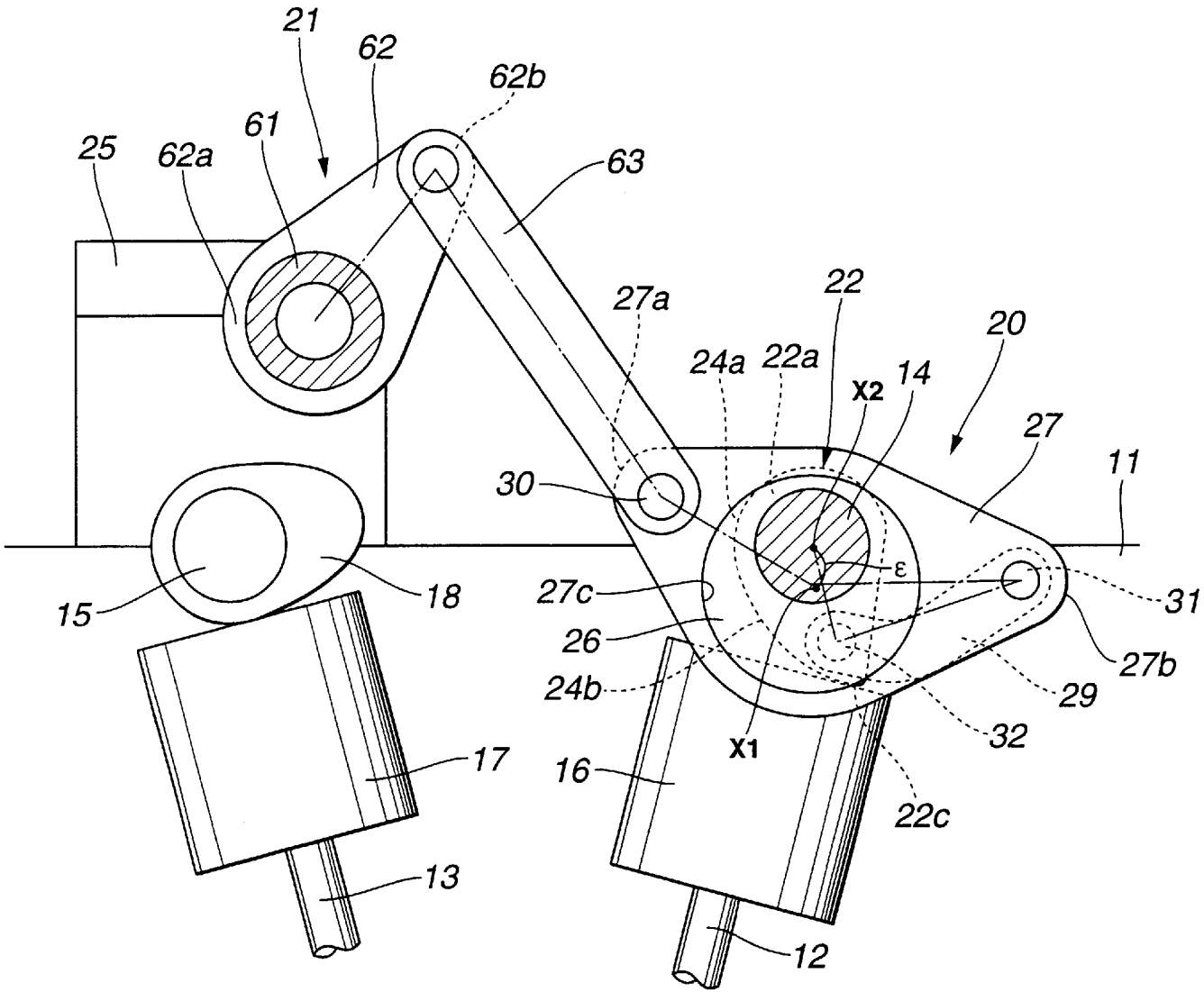
FIG. 18 is an explanatory view showing the operation of the valve operating device of the fifth embodiment.

Referring now to FIGS. 17 and 18, there is shown the valve operating device of the fifth embodiment. The device of the fifth embodiment of FIGS. 17 and 18 is different from that of the fourth embodiment of FIGS. 13–16, in that the previously-noted control cam (third eccentric cam) 70 is eliminated and in lieu thereof the large-diameter portion 62*a* of control arm 62 (formed as a comparatively short straight link), is directly fixed to the control shaft 61 (formed as a cylindrical hollow shaft), while the small-diameter portion 62*b* of control arm 62 is mechanically linked via a straight link arm 63 to the first end 27*a* of rocker arm 27. In case of the linkage layout of FIGS. 17 and 18, the amount of rotary motion of the small-diameter portion 62*b* of control arm 62 tends to increase, and thus the operating angle of control shaft 61 can be set to a relatively small operating angle. This contributes to the reduced load of actuator 34. Thus, it is possible to downsize the actuator, thereby reducing the total size of the device, and consequently reducing power consumption.

Figure 19:
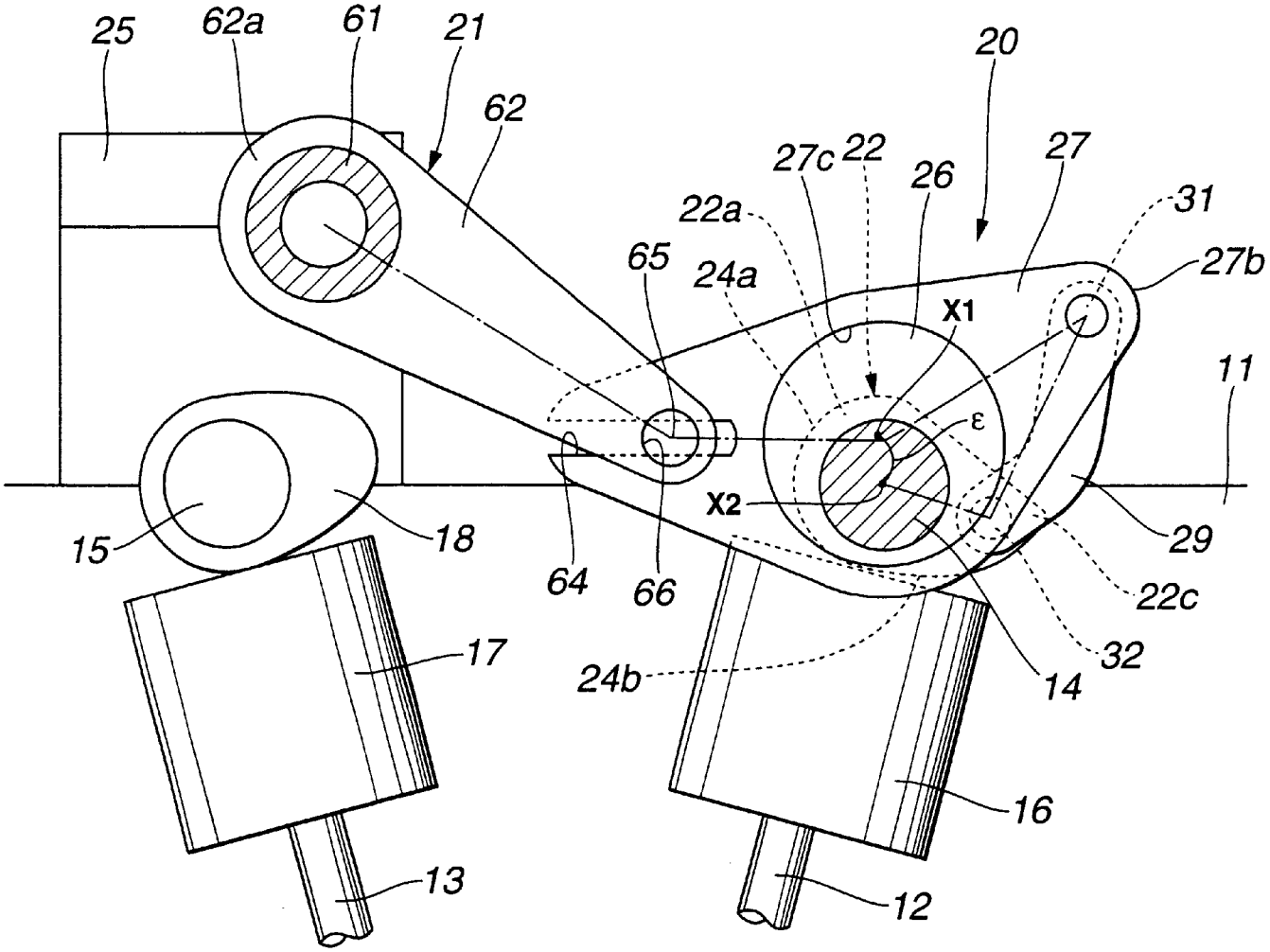
FIG. 19 is a cross-sectional view of the essential part of a sixth embodiment of a valve operating device.
Figure 20:
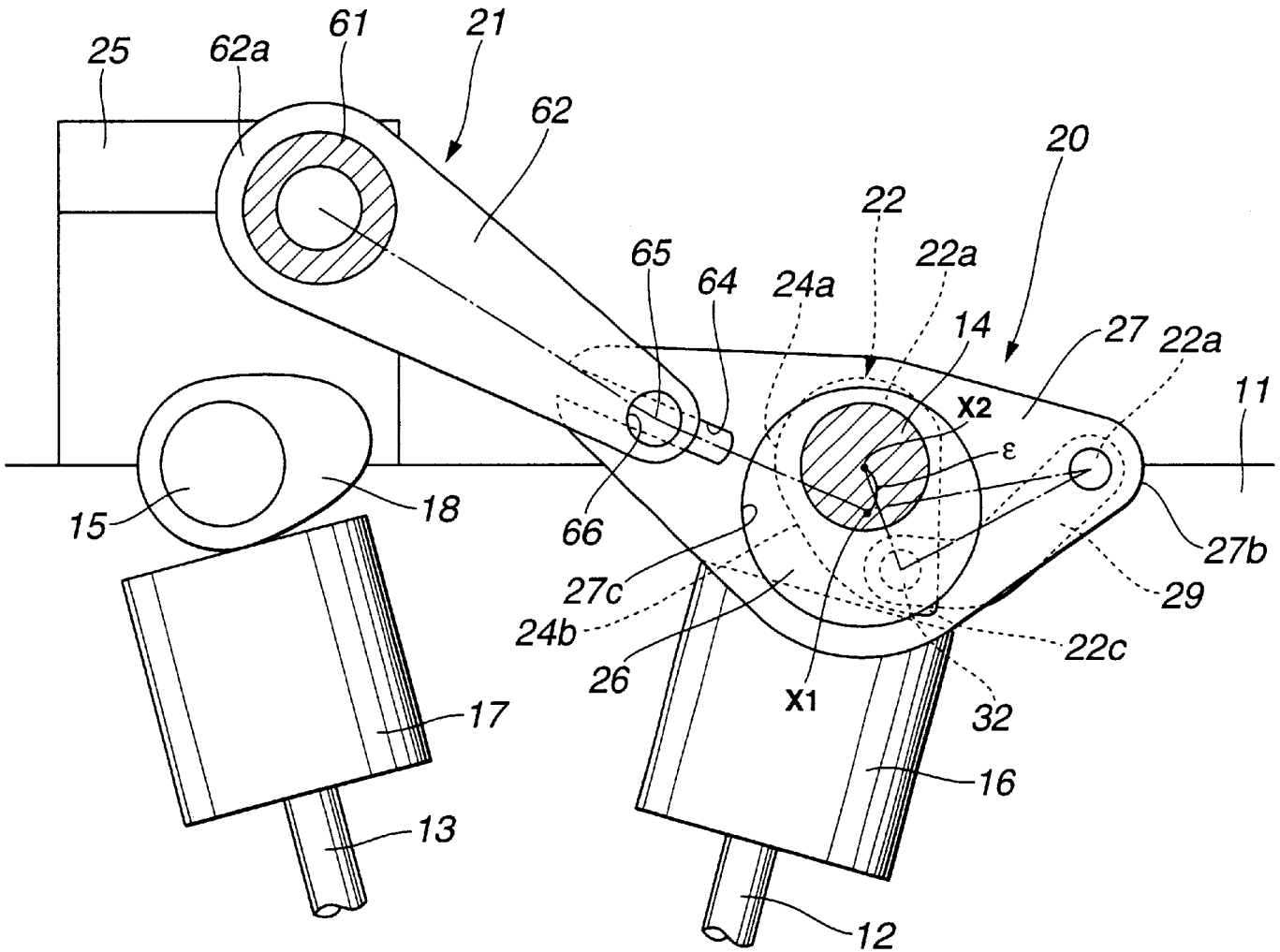
FIG. 20 is an explanatory view showing the operation of the valve operating device of the sixth embodiment.

Referring now to FIGS. 19 and 20, there is shown the valve operating device of the sixth embodiment. The device of the sixth embodiment of FIGS. 19 and 20 is different from the fourth (FIGS. 13–16) and fifth (FIGS. 17–18) embodiments, in that the control cam (third eccentric cam) 70 and link arm 63 are eliminated and in lieu thereof a cam slot (or a slit) 64 is provided at the first end of rocker arm 27 so that the cam slot 64 is partly formed along the rocker-arm neutral axis indicated by the one-dotted line in FIG. 19, and a sliding pin 65 is attached to the small-diameter portion of control arm 62 so that the sliding pin 65 is slidably engaged with the cam slot 64. The root portion of sliding pin 65 is rotatably supported in a pin holding hole 66 bored in the small-diameter portion of control arm 62. Sliding pin 65 has width across flats (two parallel flat faces) formed at its tip end. The two parallel flat faces formed at the tip of sliding pin 65 are in sliding-contact with the respective opposing inner peripheral wall surfaces of cam slot 64. Actually, a snap ring (not shown) is fitted to the root portion of sliding pin 65, to prevent the sliding pin from falling out of the pin holding hole 66. According to the device of the sixth embodiment shown in FIGS. 19 and 20, the two parallel flat-faced portion of the tip end of sliding pin 65 variably controls the center of oscillating motion of rocker arm 27, while sliding in the cam slot 64 owing to rotation of control shaft 61. The linkage arrangement (the sliding-pin-slot engagement) shown in FIGS. 19 and 20 enhances the accuracy of variable control for the center of oscillating motion of rocker arm 27. Due to the pin-slot engagement, the number of parts of the device can be decreased, and the linkage structure can be simplified, thereby reducing production costs.

In the fourth, fifth and sixth embodiments described previously, although the improved valve operating device is applied to an internal combustion engine with one intake valve 12 and one exhaust valve 13 for each engine cylinder, it will be appreciated that the device of the fourth, fifth and sixth embodiments can be applied to an internal combustion engine with a pair of intake valves (12, 12) and a pair of exhaust valves (13, 13) for each engine cylinder. In this case, the cam profiles of two adjacent rockable cams (22, 22) for the intake valve pair (12, 12) may be the same. Alternatively, a cam profile of one of the rockable cams (22, 22) may be different from a cam profile of the other, so as to provide a valve-lift difference between the two intake valves (12, 12) for each engine cylinder. Due to the valve-lift difference, swirl flow in each engine cylinder can be effectively strengthened, thereby improving the combustibility of the engine. In the fourth, fifth and sixth embodiments discussed above, as can be appreciated from the characteristic curves shown in FIG. 6, in order to mainly vary valve timing and valve lift characteristic of intake valve 12, the first camshaft to which at least second eccentric cams 26, rocker arms 27 and rockable cams 22 are attached is set or used as an intake camshaft 14, whereas the second camshaft to which at least drive cams 18 are attached is set or used as an exhaust camshaft 15. Alternatively, in order to mainly vary valve timing and valve lift characteristics of exhaust valves (13, 13), the second camshaft to which at least drive cams 18 are attached may be set or used as an intake camshaft 14, whereas the first camshaft to which at least second eccentric cams 26, rocker arms 27 and rockable cams 22 are attached may be set or used as an exhaust camshaft 15.

The entire contents of Japanese Patent Application Nos. P2000-286341 (filed Sep. 21, 2000) and P2000-293573 (filed Sep. 27, 2000) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A valve operating device for an internal combustion engine enabling both valve timing and valve lift characteristic to be varied depending on engine operating conditions, comprising:

intake and exhaust camshafts;

an eccentric cam fixedly connected to a first one of the intake and exhaust camshafts so that an axis of the eccentric cam is eccentric to an axis of the first camshaft;

a rockable cam supported on the first camshaft so that the rockable cam rotates or oscillates about the axis of the first camshaft;

a rocker arm oscillatingly supported on an outer periphery of the eccentric cam so that a center of an oscillating motion of the rocker arm revolves around the axis of the first camshaft; and a control shaft that variably controls the center of the oscillating motion of the rocker arm.

2. A valve operating device for an internal combustion engine enabling both valve timing and valve lift characteristic to be varied depending on engine operating conditions, comprising:

intake and exhaust camshafts;

a rockable cam oscillatingly supported on a first one of the intake and exhaust camshafts for operating an engine valve associated with the first camshaft by an oscillating motion of the rockable cam;

a drive cam fixedly connected to an outer periphery of the second camshaft adapted to be driven by an engine crankshaft for operating an engine valve associated with the second camshaft;

a power-transmission mechanism that produces the oscillating motion of the rockable cam by converting a rotary motion of the second camshaft into an oscillating motion; and a control mechanism that variably controls a valve lift characteristic of the engine valve associated with the first camshaft by controlling an angular position of the first camshaft and thus changing a sliding-contact position of the rockable cam with respect to the engine valve associated with the first camshaft.

3. The valve operating device as claimed in claim 2, wherein:

the power-transmission mechanism comprises a first eccentric cam fixedly connected to the second camshaft so that an axis of the first eccentric cam is eccentric to an axis of the second camshaft and a rocker arm oscillatingly supported on the first camshaft, the rocker arm mechanically linked at its first end to the first eccentric cam and at the second end to the rockable cam; and the control mechanism comprises the first camshaft serving as a control shaft, an actuator driving the first camshaft to control the angular position of the first camshaft depending on the engine operating conditions, and a second eccentric cam fixedly connected to an outer periphery of the first camshaft so that an axis of the second eccentric cam is eccentric to an axis of the first camshaft, the second eccentric cam serving as a control cam on which the rocker arm is oscillatingly supported.

4. The valve operating device as claimed in claim 3, wherein the power-transmission mechanism comprises a link arm extending in a transverse direction of the engine and mechanically linking the first eccentric cam to the first end of the rocker arm, and a link rod mechanically linking the second end of the rocker arm to the rockable cam.

5. The valve operating device as claimed in claim 3, wherein the power-transmission mechanism comprises a link arm extending in a transverse direction of the engine and mechanically linking the first eccentric cam to the first end of the rocker arm, and a cam slot formed in the rockable cam and a sliding pin provided at the second end of the rocker arm and slidably engaged with the cam slot to mechanically linking the second end of the rocker arm to the rockable cam by pin-slot engagement of the pin with the cam slot.

6. The valve operating device as claimed in claim 3, wherein the first eccentric cam and the rocker arm, both included in the power-transmission mechanism, and the second eccentric cam included in the control mechanism are laid out within a space defined between two adjacent engine cylinders.

7. The valve operating device as claimed in claim 2, wherein:

the power-transmission mechanism comprises a first eccentric cam fixedly connected to the second camshaft so that an axis of the first eccentric cam is eccentric to an axis of the second camshaft and a rocker arm oscillatingly supported on an outer periphery of the first eccentric cam, the rocker arm mechanically linked at its first end to the control mechanism and at the second end to the rockable cam; and the control mechanism comprises the first camshaft serving as a control shaft, an actuator driving the first camshaft to control the angular position of the first camshaft depending on the engine operating conditions, and a second eccentric cam fixedly connected to an outer periphery of the first camshaft so that an axis of the second eccentric cam is eccentric to an axis of the first camshaft, the second eccentric cam serving as a control cam that controls a center of an oscillating motion of the rocker arm.

8. The valve operating device as claimed in claim 7, wherein the power-transmission mechanism comprises a link arm extending in a transverse direction of the engine and mechanically linking the first end of the rocker arm to the second eccentric cam, and a link rod mechanically linking the second end of the rocker arm to the rockable cam.

* * * * *